US011234877B2

(12) United States Patent
Melcher et al.

(10) Patent No.: US 11,234,877 B2
(45) **Date of Patent: *Feb. 1, 2022**

(54) THERAPEUTIC CUSHION SYSTEMS AND METHODS

(71) Applicant: Amenity Health, Inc., San Diego, CA (US)

(72) Inventors: Carl Melcher, La Jolla, CA (US); Aaron Clark, San Diego, CA (US); Clint Erickson, San Diego, CA (US)

(73) Assignee: Amenity Health, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/712,297

(22) Filed: Dec. 12, 2019

(65) Prior Publication Data

US 2020/0222259 A1 Jul. 16, 2020

Related U.S. Application Data

(63) Continuation of application No. 16/002,522, filed on Jun. 7, 2018, now Pat. No. 10,512,576, which is a (Continued)

(51) Int. Cl.
*A61G 7/075* (2006.01)
*A61G 7/07* (2006.01)
(Continued)

(52) U.S. Cl.
CPC ..... *A61G 7/075* (2013.01); *A47C 20/00* (2013.01); *A47C 20/023* (2013.01);
(Continued)

(58) Field of Classification Search
CPC .... A47G 9/1063; A47G 9/1081; A47G 9/109; A47C 20/00; A47C 20/02; A47C 20/026;
(Continued)

(56) References Cited

U.S. PATENT DOCUMENTS 254,759 A 3/1882 Young
2,149,140 A 2/1939 Gonzalez-Rincones
(Continued)

FOREIGN PATENT DOCUMENTS

CA 2863395 A1 * 8/2013 ..... A47C 20/023
CN 2618511 Y 6/2004
(Continued)

OTHER PUBLICATIONS

Office Action for Australian Patent Application No. 2013214928, dated Jun. 8, 2017, 7 pages.
(Continued)

*Primary Examiner* — Robert G Santos
(74) *Attorney, Agent, or Firm* — Cooley LLP

(57) ABSTRACT

Apparatus and methods for providing therapeutic treatment for symptoms associated with GERD and/or other digestive disorders and/or other medical conditions are described herein. In some embodiments, an apparatus includes a support element and a conformable riser element adjacent the support element. The riser element and the support element collectively form a body support member configured to support a user and define a receiving portion configured to receive a portion of the user's arm. The riser element and the support element are each disposed within a casing formed at least in part with a stretch material. In some embodiments, the riser element includes a polyester filler material and the stretch material includes a four-way stretch material. The four-way stretch material in combination with the polyester filler material enables the riser element to be conformable.

22 Claims, 20 Drawing Sheets

Related U.S. Application Data continuation of application No. 14/376,372, filed as application No. PCT/US2013/024358 on Feb. 1, 2013, now Pat. No. 9,993,379.

(60) Provisional application No. 61/710,913, filed on Oct. 8, 2012, provisional application No. 61/683,935, filed on Aug. 16, 2012, provisional application No. 61/594,840, filed on Feb. 3, 2012.

(51) Int. Cl.
*A61G 7/10* (2006.01)
*A47C 20/00* (2006.01)
*A47C 20/02* (2006.01)

(52) U.S. Cl.
CPC ..... *A47C 20/027* (2013.01); *A61G 7/07* (2013.01); *A61G 7/1021* (2013.01); *A47C 20/021* (2013.01)

(58) Field of Classification Search
CPC .... A47C 20/027; A47C 20/023; A61G 7/075; A61G 7/07; A61G 7/1021
USPC ... 5/630, 632–634, 636, 640, 646, 648, 652, 5/657
See application file for complete search history.

(56) References Cited

U.S. PATENT DOCUMENTS 2,182,861 A 12/1939 Albert
2,295,906 A 9/1942 Lacour
2,522,120 A 9/1950 Kaskey et al.
2,550,293 A 4/1951 Platis
3,315,282 A 4/1967 Lowery et al.
3,333,286 A 8/1967 Biolik
D222,005 S 9/1971 Kelly
3,926,181 A 12/1975 Eischen, Sr.
3,938,205 A 2/1976 Spann
4,118,813 A 10/1978 Armstrong
4,173,048 A 11/1979 Varaney
4,214,326 A 7/1980 Spann
D263,500 S 3/1982 Janko
4,359,045 A 11/1982 Cozzi
4,393,530 A 7/1983 Stark
D271,647 S 12/1983 McLeod
D295,248 S 4/1988 Sommerfield et al.
4,802,249 A 2/1989 Bills
D301,166 S 5/1989 Miklja
4,853,993 A 8/1989 Walpin et al.
4,901,384 A 2/1990 Eary
4,907,306 A 3/1990 Nakaji
D309,542 S 7/1990 Glenn
D310,312 S 9/1990 Wong et al.
4,987,625 A 1/1991 Edelson
5,014,375 A 5/1991 Coonrad et al.
5,035,015 A 7/1991 Maietta
D319,365 S 8/1991 Edelson
5,095,569 A 3/1992 Glenn
5,097,551 A 3/1992 Smith
5,125,123 A 6/1992 Engle
D328,349 S 7/1992 Waldrop
5,153,960 A 10/1992 Ritter et al.
5,231,717 A 8/1993 Scott et al.
5,289,828 A 3/1994 Toth
5,412,824 A 5/1995 Emerson et al.
5,423,099 A 6/1995 Gulli
5,440,770 A 8/1995 Nichols
5,479,667 A 1/1996 Nelson et al.
5,509,153 A 4/1996 Roschacher
5,561,879 A 10/1996 Everall
5,632,050 A 5/1997 Zajas et al.
5,652,981 A 8/1997 Singer-Leyton et al.
D385,143 S 10/1997 Straub
5,697,112 A 12/1997 Colavito et al.
D390,665 S 2/1998 Kennemore
5,713,091 A 2/1998 Houchin
5,800,368 A 9/1998 Klingemann
5,815,863 A 10/1998 Dolisi
5,890,765 A 4/1999 LaPointe et al.
5,893,183 A 4/1999 Bechtold, Jr.
D416,428 S 11/1999 Jackson
5,987,674 A 11/1999 Schaffner et al.
6,032,669 A 3/2000 Klein
6,052,848 A 4/2000 Kelly
6,105,187 A 8/2000 Gnjatovic
6,175,979 B1 1/2001 Jackson
6,185,768 B1 2/2001 Schlechter
D441,587 S 5/2001 Cameron
6,226,817 B1 5/2001 Rubio
6,230,350 B1 5/2001 Goldstein
D446,676 S 8/2001 Mayes
6,270,155 B1 8/2001 Rashid
6,276,012 B2 8/2001 Borders
D447,805 S 9/2001 Siegal
D448,227 S 9/2001 Straub
6,292,964 B1 9/2001 Rose et al.
6,321,403 B1 11/2001 Matthews
6,324,710 B1 12/2001 Hernandez et al.
6,334,442 B1 1/2002 Altamura
D453,653 S 2/2002 Tunnell
6,446,288 B1 9/2002 Pi
6,499,164 B1 12/2002 Leach
6,553,995 B1 4/2003 Cole et al.
6,622,727 B2 9/2003 Perry
6,634,045 B1 10/2003 DuDonis et al.
6,757,925 B1 7/2004 Toomer
6,817,049 B1 11/2004 Hall
D500,622 S 1/2005 Owen
6,898,812 B2 5/2005 Smart
6,913,019 B2 7/2005 Johns et al.
6,922,861 B1 8/2005 Mathis
6,925,670 B2 8/2005 Torrez
6,954,953 B2 10/2005 Borden
7,020,918 B1 4/2006 Tinsley
7,134,158 B2 11/2006 Tokarz
7,201,757 B2 4/2007 Knudson et al.
7,322,061 B2 1/2008 Carroll
7,328,471 B1 2/2008 Stohr
7,353,552 B2 4/2008 Leach
7,404,222 B2 7/2008 Tidwell
7,415,743 B2 8/2008 Rubio
D578,220 S 10/2008 Ebarb
7,536,741 B1 5/2009 Schultz
7,546,651 B2 6/2009 Groteke et al.
7,578,013 B2 8/2009 Aikman
D601,776 S 10/2009 Loret
7,607,185 B1 10/2009 Minson
7,669,926 B2 3/2010 Balensiefer
7,698,766 B2 4/2010 Schultz
D619,401 S 7/2010 Deenadayalu et al.
D619,404 S 7/2010 Castillo
7,793,371 B1 9/2010 Leach
D635,265 S 3/2011 Coffey et al.
7,908,691 B2 3/2011 Small
D642,278 S 7/2011 Sharps et al.
D643,125 S 8/2011 Seidel
8,006,335 B1 8/2011 Andermann
8,069,515 B1 12/2011 Tingey
8,074,310 B1 12/2011 Robbins
8,118,268 B2 2/2012 Mabry
D655,559 S 3/2012 Cheng
8,136,186 B1 3/2012 Leach
8,205,285 B1 6/2012 Klingemann
8,220,091 B2 7/2012 Schultz
D665,503 S 8/2012 Dennewald
D665,912 S 8/2012 Skripps
8,234,735 B2 8/2012 Schultz
8,261,386 B2 9/2012 Kardos
8,291,534 B2 10/2012 Karlson
8,640,289 B2 2/2014 Reeder, Jr.
8,646,134 B1 2/2014 Alleto, Jr.
8,661,586 B2 3/2014 Melcher et al.
8,695,134 B2 4/2014 Schultz

(56) References Cited

U.S. PATENT DOCUMENTS

| | | | | |
|---|---|---|---|---|
| 8,745,793 | B2 | 6/2014 | Bensoussan | |
| D708,752 | S | 7/2014 | Oberst | |
| D715,579 | S | 10/2014 | Scarlett | |
| 8,887,331 | B2 | 11/2014 | Nakamura et al. | |
| D732,174 | S | 6/2015 | Johnson | |
| D733,897 | S | 7/2015 | Rossouw | |
| D736,391 | S | 8/2015 | Johnson | |
| D736,541 | S | 8/2015 | Maldonado | |
| 9,220,359 | B2 | 12/2015 | Long | |
| D754,353 | S | 4/2016 | Pileski et al. | |
| 9,386,859 | B2 | 7/2016 | Schultz | |
| 9,427,366 | B2 | 8/2016 | Melcher et al. | |
| D771,414 | S | 11/2016 | Krishtul | |
| 9,510,686 | B2 | 12/2016 | Abraham | |
| D779,236 | S | 2/2017 | Ribble et al. | |
| D783,834 | S | 4/2017 | Johnson et al. | |
| D785,184 | S | 4/2017 | Higgins et al. | |
| 9,717,342 | B2 | 8/2017 | Bates | |
| D800,480 | S | 10/2017 | Paperno | |
| D804,850 | S | 12/2017 | Acosta De Nicolo | |
| 9,993,379 | B2 | 6/2018 | Melcher et al. | |
| 10,022,285 | B2 | 7/2018 | Melcher et al. | |
| D841,819 | S | 2/2019 | Clark et al. | |
| D848,763 | S | 5/2019 | Potter | |
| 10,349,752 | B2 | 7/2019 | Melcher et al. | |
| D855,354 | S | 8/2019 | Zanki et al. | |
| D856,708 | S | 8/2019 | Chen | |
| D862,116 | S | 10/2019 | Zanki | |
| D871,593 | S | 12/2019 | Rossouw | |
| 10,512,576 | B2 | 12/2019 | Melcher et al. | |
| D875,949 | S | 2/2020 | Clark et al. | |
| 10,660,807 | B2 | 5/2020 | Ribble et al. | |
| 2003/0182727 | A1 | 10/2003 | DuDonis et al. | |
| 2003/0217412 | A1 | 11/2003 | Johns et al. | |
| 2004/0116195 | A1 | 6/2004 | Lee | |
| 2004/0168257 | A1 | 9/2004 | Torrez | |
| 2006/0230539 | A1 | 10/2006 | Goodman | |
| 2007/0067915 | A1 | 3/2007 | Pryor | |
| 2007/0182233 | A1 | 8/2007 | Boyko | |
| 2008/0134437 | A1 | 6/2008 | Small | |
| 2008/0256704 | A1 | 10/2008 | Conway | |
| 2009/0126117 | A1 | 5/2009 | Lazarus | |
| 2009/0144905 | A1 | 6/2009 | Javaruski et al. | |
| 2009/0222991 | A1 | 9/2009 | Davis, III | |
| 2009/0222997 | A1 | 9/2009 | Schultz | |
| 2010/0122418 | A1 | 5/2010 | Adler | |
| 2010/0132119 | A1 | 6/2010 | Taghikhani | |
| 2010/0186171 | A1 | 7/2010 | Schultz | |
| 2010/0199436 | A1 | 8/2010 | Schultz | |
| 2010/0229875 | A1 | 9/2010 | Davis | |
| 2011/0056503 | A1 | 3/2011 | Abraham | |
| 2011/0296615 | A1 | 12/2011 | Tingey | |
| 2012/0023669 | A1 | 2/2012 | Graller et al. | |
| 2012/0272452 | A1 | 11/2012 | Schultz | |
| 2013/0198962 | A1* | 8/2013 | Melcher | A61G 7/075 5/652 |
| 2013/0198965 | A1 | 8/2013 | Melcher et al. | |
| 2014/0173829 | A1* | 6/2014 | Melcher | A47C 20/023 5/646 |
| 2014/0331411 | A1 | 11/2014 | Schultz | |
| 2014/0366274 | A1* | 12/2014 | Melcher | A47C 20/00 5/646 |
| 2016/0037946 | A1* | 2/2016 | Melcher | A47C 20/023 5/636 |
| 2016/0213175 | A1* | 7/2016 | Melcher | A47C 20/02 |
| 2018/0344042 | A1 | 12/2018 | Melcher et al. | |
| 2019/0083340 | A1* | 3/2019 | Melcher | A47C 20/00 |
| 2019/0099309 | A1 | 4/2019 | Melcher et al. | |
| 2019/0298073 | A1 | 10/2019 | Melcher et al. | |
| 2020/0222259 | A1* | 7/2020 | Melcher | A47C 20/023 |

FOREIGN PATENT DOCUMENTS

| | | | | |
|---|---|---|---|---|
| CN | 101731876 | A | 6/2010 | |
| CN | 201578261 | U | 9/2010 | |
| CN | 201879284 | U | 6/2011 | |
| CN | 202821939 | U | 3/2013 | |
| CN | 103637597 | A | 3/2014 | |
| CN | 203483617 | U | 3/2014 | |
| CN | 103816017 | A | 5/2014 | |
| EP | 2809284 | B1 * | 9/2017 | A47C 20/023 |
| JP | 2005-185739 | A | 7/2005 | |
| JP | 3129197 | U | 2/2007 | |
| JP | 3132068 | U | 5/2007 | |
| JP | 2007-159818 | A | 6/2007 | |
| WO | WO 97/05807 | | 2/1997 | |
| WO | WO-2008-023724 | A1 | 2/2008 | |
| WO | WO 2013/116658 | | 8/2013 | |
| WO | WO 2013/116676 | | 8/2013 | |
| WO | WO 2016/022886 | | 2/2016 | |

OTHER PUBLICATIONS

Office Action for Chinese Patent Application No. 201380016317.8, dated Jun. 20, 2016, 32 pages.

Office Action for Eurasian Patent Application No. 201491465, dated May 20, 2016, 6 pages.

Office Action for European Patent Application No. 13742902.3, dated Aug. 18, 2016, 5 pages.

Supplementary European Search Report for European Application No. 13742902.3, dated Oct. 16, 2015, 6 pages.

Office Action for Japanese Patent Application No. 2014-555766, dated Nov. 17, 2016, 16 pages.

Final Office Action for Japanese Patent Application No. 2014-555766, dated Feb. 22, 2017, 4 pages.

Office Action for Mexican Patent Application No. MX/a/2014/009258, dated Sep. 22, 2016, 12 pages.

Office Action for U.S. Appl. No. 13/757,172, dated Jun. 21, 2013, 7 pages.

International Search Report and Written Opinion for International Application No. PCT/US2013/024378, dated May 23, 2013, 15 pages.

International Search Report and Written Opinion for International Application No. PCT/US2013/024358, dated May 23, 2013, 11 pages.

Office Action for U.S. Appl. No. 13/757,120, dated Jul. 1, 2013, 7 pages.

Office Action for U.S. Appl. No. 14/195,749, dated Oct. 5, 2015, 5 pages.

Office Action for U.S. Appl. No. 14/195,749, dated Jun. 7, 2016, 13 pages.

Office Action for U.S. Appl. No. 14/195,749, dated Feb. 3, 2017, 10 pages.

Office Action for U.S. Appl. No. 14/195,749, dated Sep. 21, 2017, 11 pages.

Office Action for U.S. Appl. No. 14/376,372, dated May 15, 2017, 11 pages.

Office Action for U.S. Appl. No. 14/455,389, dated Jan. 15, 2015, 7 pages.

Office Action for U.S. Appl. No. 14/455,389, dated Aug. 5, 2015, 14 pages.

Office Action for U.S. Appl. No. 14/820,832, dated Sep. 12, 2018, 20 pages.

International Search Report and Written Opinion for International Application No. PCT/US2015/044151, dated Feb. 2, 2016, 10 pages.

Office Action for Chinese Patent Application No. 201380016317.8, dated May 15, 2017, 67 pages.

Extended European Search Report dated Feb. 21, 2018, for EP Application No. 15 829 598.0, filed on Aug. 7, 2015, 7 pages.

Office Action for Chinese Patent Application No. 201380016317.8, dated Feb. 7, 2018, 36 pages.

Office Action for Chinese Patent Application No. 201380016317.8, dated Oct. 31, 2018, 2018, 22 pages.

(56) References Cited

OTHER PUBLICATIONS

Office Action for Australian Patent Application No. 2013214928, dated Apr. 17, 2018, 5 pages.
Office Action for Indonesian Patent Application No. P00201405250, dated May 16, 2018, 3 pages.
Office Action for U.S. Appl. No. 14/820,832, dated Feb. 21, 2018, 14 pages.
MedCline Acid Reflux System. [online] Retrieved Jun. 7, 2018 from URL: https://www.amazon.com/MedCline-Acid-Reflux-Ssytem-Large/ dp/BOICRB7BMO.
Zerlar Memory Cotton Lunch Break Face Down Head Rest Pillow Cushion. [online] Published. Dec. 19, 2017. Retrieved Jun. 7, 2018 from URL: https://www.amazon.com/Zerlar-Memory-Cotton-CushionStudent/dp/B075JFM9HC/ref=sr_1_20_s_it?s=hpc&ie=UTF8&qid=1528377772&sr+1-20&keywords=Medicine&th=1.
Office Action for Chinese Patent Application No. 2015800522767, dated Sep. 25, 2018, 20 pages.
Office Action for U.S. Appl. No. 16/002,522, dated Jan. 4, 2019, 12 pages.
Office Action for Israeli Application No. 250436, dated Jan. 3, 2019, 3 pages.
Office Action for Canadian Patent Application No. 2,863,395, dated Mar. 5, 2019, 3 pages.
Examination Report for Australian Patent Application No. 2018203949, dated Mar. 21, 2019, 3 pages.
Examination Report for Australian Patent Application No. 2015300905, dated Apr. 15, 2019, 4 pages.
Office Action for Japanese Application No. 2017-508097, dated Apr. 25, 2019, 10 pages. (English Translation included).
Office Action for Chinese Patent Application No. 2013800163178, dated Jun. 6, 2019, 15 pages. (English Translation included).
Partial European Search Report dated Oct. 23, 2019, for EP Application No. 19184198.0, filed on Aug. 7, 2015, 3 pages.
Partial European Search Report dated Jan. 23, 2020, for EP Application No. 19184198.0, filed on Aug. 7, 2015, 9 pages.
Office Action for Mexican Patent Application No. MX/a/2017/001692, dated Feb. 6, 2020, 6 pages. (translation included).
Office Action for Japanese Patent Application No. 2017-508097, dated Mar. 13, 2020, 6 pages. (translation included).
Office Action for Brazilian Patent Application No. 1120170025116, dated May 5, 2020, 6 pages. (translation included).
First Examination Report for Indian Patent Application No. 1882/KOLNP/2014, dated May 22, 2020, 8 pages. (translation included).
Examiner's Report for Canadian Patent Application No. 2,863,395, dated Aug. 12, 2020, 3 pages.
Office Action for Brazilian Patent Application No. 1220200044969, dated Aug. 28, 2020, 2 pages. (translation included).
Office Action for European Patent Application No. 19184198.0, dated Sep. 28, 2020, 4 pages.
First Examination Report for Indian Patent Application No. 201737005110, dated Oct. 12, 2020, 7 pages. (translation included).
Office Action for U.S. Appl. No. 15/991,414, dated Nov. 30, 2020, 24 pages.
Office Action for Brazilian Patent Application No. 1120140192600, dated Nov. 3, 2020, 8 pages. (translation included).
Office Action for U.S. Appl. No. 16/020,123, dated Mar. 23, 2021, 20 pages.
Office Action for U.S. Appl. No. 16/447,604, dated Mar. 29, 2021, 17 pages.
Office Action for Brazilian Patent Application No. 1120140192600, dated Apr. 6, 2021, 8 pages. (translation included).
Office Action for Chinese Patent Application No. 201910735506X, dated Feb. 26, 2021, 5 pages. (translation included).
Office Action for Chinese Patent Application No. 2020103141882, dated Mar. 18, 2021, 19 pages. (translation included).
Office Action for Japanese Patent Application No. 2020-109126, dated Jun. 3, 2021, 7 pages. (translation included).
Office Action for Israeli Patent Application No. 273679, dated Jun. 20, 2021, 12 pages. (translation included).
Office Action for Brazilian Patent Application No. 1220200044969, dated Jun. 18, 2021, 6 pages. (translation included).
Office Action for Australian Patent Application No. 2020203947, dated Jun. 30, 2021, 5 pages.
Examination Report No. 1 for Australian Patent Application No. 2020204454, dated Aug. 6, 2021, 4 pages.
Office Action for Chinese Patent Application No. 201910735506X, dated Jul. 5, 2021, 9 pages. (translation included).

* cited by examiner

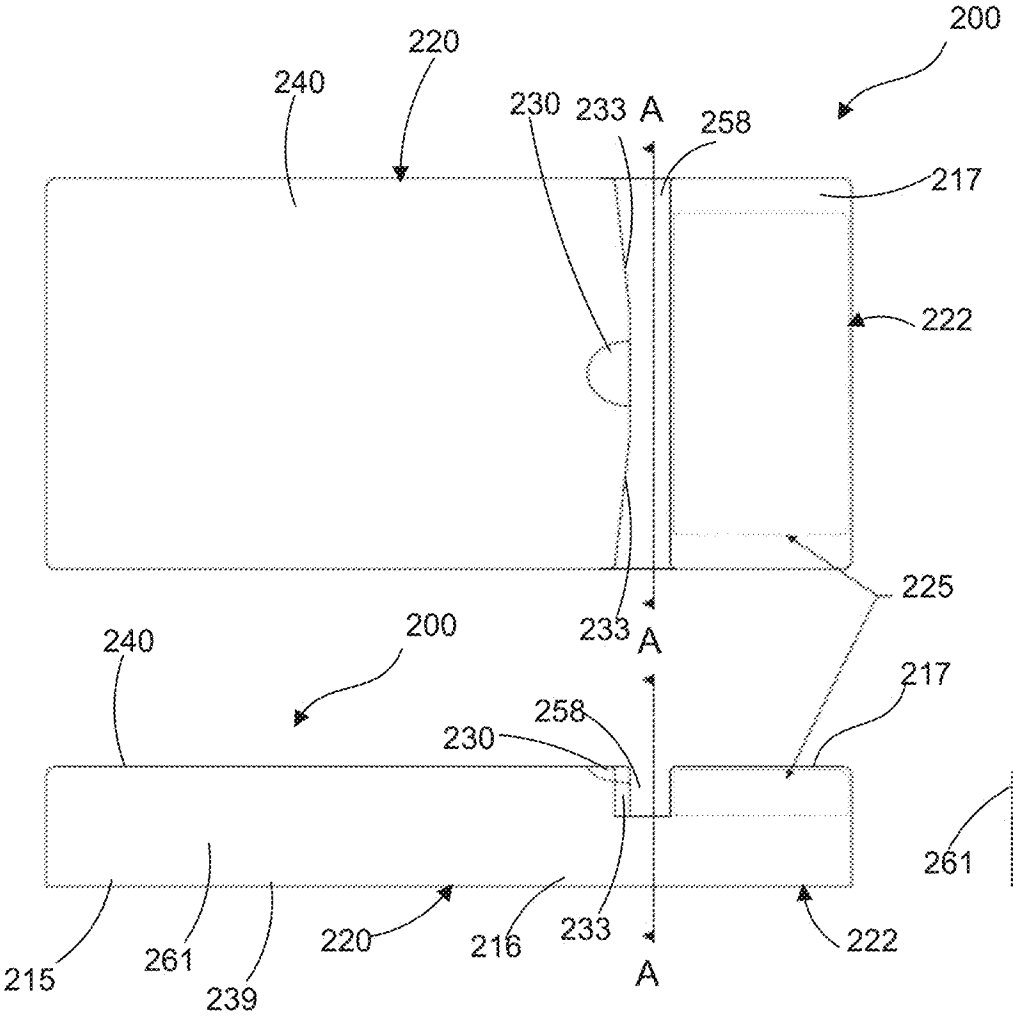
FIG. 2
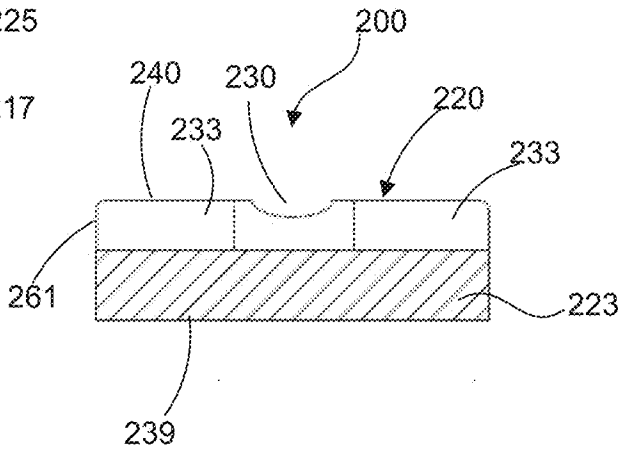
FIG. 4
FIG. 3

THERAPEUTIC CUSHION SYSTEMS AND METHODS

CROSS-REFERENCE TO RELATED APPLICATIONS

This application is a continuation of U.S. patent Ser. No. 16/002,522, entitled "Therapeutic Cushion Systems and Methods," filed Jun. 7, 2018 (now U.S. Pat. No. 10,512,576), which is a continuation of U.S. patent application Ser. No. 14/376,372, entitled "Therapeutic Cushion Systems and Methods," filed Aug. 1, 2014 (now U.S. Pat. No. 9,993,379), which is a 371 national phase application of International Patent Application No. PCT/US2013/024358, filed Feb. 1, 2013 and claims priority to and the benefit from U.S. Provisional Application No. 61/594,840, entitled "Therapeutic Cushion System," filed Feb. 3, 2012, and U.S. Provisional Application No. 61/683,935, entitled "Therapeutic Cushion Systems and Methods," filed Aug. 16, 2012, and U.S. Provisional Application No. 61/710,913, entitled "Therapeutic Cushion Systems and Methods," filed Oct. 8, 2012, each of the disclosures of which is incorporated herein by reference in its entirety.

BACKGROUND

Some embodiments described herein relate to therapeutic cushion systems and methods, and in particular, to therapeutic cushion systems and methods for use in the treatment of various medical conditions, such as, for example, gastro-esophageal reflux disease.

Gastro-esophageal reflux disease (GERD) is a medical term that describes a malady in which acid-laden, partially digested stomach contents reflux—i.e., flow in an abnormal backward fashion—from the stomach into the esophagus. Reflux of gastric contents into the esophagus is most common, and does the most damage, when the GERD sufferer is sleeping and unaware that the reflux is occurring.

Some known systems use pillows or other supportive apparatuses to effectively manage or control symptoms of conditions that otherwise would have required a medical prescription or surgery to alleviate. For example, some known pillow options include an elevated pillow with a protrusion within the pillow focused on the cervical region of the neck, which is intended to provide comfort or better resting conditions for individuals suffering from cardiac conditions, emphysema or other respiratory difficulties. Such a pillow does not allow for an extended support below the sacrum region of the spine; nor does the pillow provide for any comfortable position other than supine.

Some known devices include an orthopedic pillow that can be used to minimize snoring in an individual. While such a pillow can be used to address conditions such as snoring, such a pillow may not be configured to treat conditions such as GERD. In fact, such an orthopedic pillow typically only provides an elevation component and fails to address any other component that may be desired for the relief of symptoms of a GERD sufferer.

Another known system includes a support pillow including a body with a central section and two wings for use in controlling symptoms associated with head and neck hyperextension, which is often seen in infants with bronchopulmonary dysplasia, or other related conditions. Another known system includes an apparatus that can be used to prevent positional plagiocephaly in an infant by distributing loads otherwise borne by the head of the infant across a horizontal surface. While these systems may provide a benefit to infants, their specific design and structural engineering is based on the user of the pillow being an infant. Such pillows are not disclosed as providing a benefit for an adult or adolescent user suffering from GERD.

Most of the above described known systems focus on conditions relating to infants and/or the head-only region, without regard to addressing support of, or interaction with, the entire body. Other known systems include a pillow meant to accommodate an adult person (as a general body pillow) or an infant (to assist in supporting the infant in a seated position). Such systems, however, do not contemplate use of the pillow to alleviate symptoms relating to gastric or esophageal disorders. Additionally, such a pillow may not accommodate the necessary features specific for controlling or managing such disorders. Another known system includes a large, contoured body pillow to facilitate relief from persistent back and neck pain, respiratory and digestive disorders; however, the bulk of such a pillow is typically in excess of what is practical for use by a normal individual in a bed.

Thus, a need exists for therapeutic cushion systems and methods that can address the shortcomings of the known pillow systems identified above, and that can be used to manage and/or control symptoms associated with GERD and/or other medical conditions, while maintaining a practical, accommodating fit for the user.

SUMMARY

Apparatus and methods for providing therapeutic treatment for symptoms associated with GERD and/or other digestive disorders and/or other medical conditions are described herein. In some embodiments, an apparatus includes a support element and a conformable riser element adjacent the support element. The riser element and the support element collectively form a body support member configured to support a user and define a receiving portion configured to receive a portion of the user's arm. The riser element and the support element are each disposed within a casing formed at least in part with a stretch material. In some embodiments, the riser element includes a polyester filler material and the stretch material includes a four-way stretch material. The four-way stretch material in combination with the polyester filler material enables the riser element to be conformable.

BRIEF DESCRIPTION OF THE DRAWINGS

FIG. 2 is a top view of a therapeutic cushion system, according to an embodiment.

FIG. 3 is a side view of the therapeutic cushion system of FIG. 2.

FIG. 4 is a cross-sectional view of the therapeutic cushion system of FIG. 2 taken along line A-A shown in FIGS. 2 and 3.

DETAILED DESCRIPTION

Apparatus and methods for providing therapeutic treatment for symptoms associated with GERD and/or other digestive disorders and/or other medical conditions or ailments are described herein. In some embodiments, a therapeutic cushion system as described herein can allow the user to sleep comfortably for an extended period of time in a substantially flat or an inclined or reclined right-side lateral decubitus (RLD) position, or a substantially flat or an inclined or reclined left-side lateral decubitus (LLD) position. In the inclined or reclined RLD position or the inclined or reclined LLD position, the therapeutic cushion system can serve to minimize, or eliminate, gastro-esophageal reflux. For example, the inclined or reclined RLD position can facilitate the emptying of the stomach into the duodenum and the inclined or reclined LLD position can facilitate the reduction of reflux episodes.

In some embodiments, an apparatus includes a support element and a conformable riser element adjacent the support element. The riser element and the support element collectively form a body support member configured to support a user and define a receiving portion configured to receive a portion of the user's arm. The riser element and the support element are each disposed within a casing formed at least in part with a stretch material.

In some embodiments, an apparatus includes a support element and a riser element disposed adjacent the support element. The riser element includes a first portion and a second portion. The second portion is configured to be moved relative to the first portion between a first position and a second position. When in the second position, the riser element and the support element collectively define a receiving portion configured to receive a portion of a user's arm.

In some embodiments, an apparatus includes a support element and a riser element adjacent the support element. The riser element and the support element are disposed on a back portion of a reclining chair configured to be moved between a substantially upright configuration and at least one reclined configuration. The riser element and the support element collectively defining a receiving portion configured to receive a portion of a user's arm.

Figure 1:
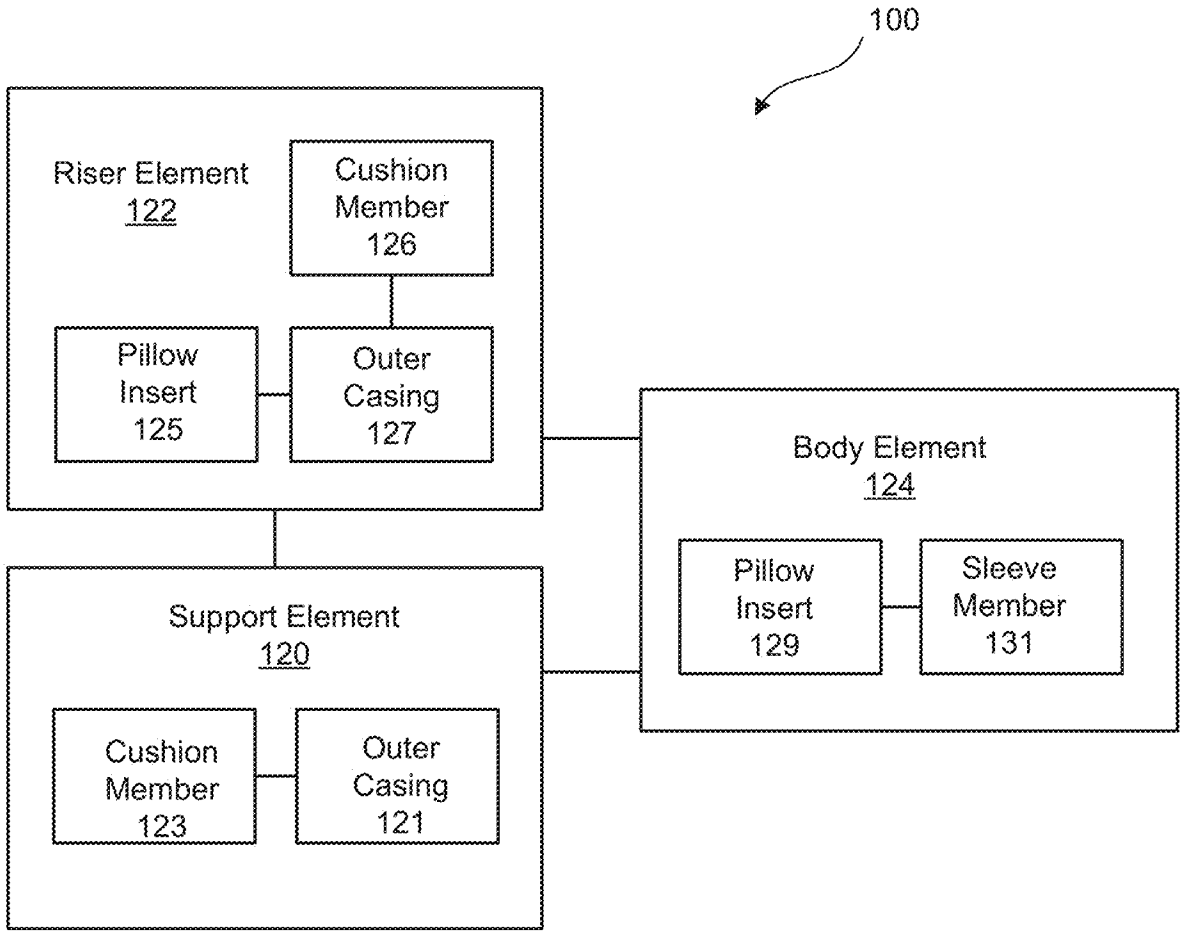
FIG. 1 is a schematic illustration of a therapeutic cushion system, according to an embodiment.

FIG. 1 is a schematic illustration of a therapeutic cushion system according to an embodiment. A therapeutic cushion system (also referred to herein as "cushion system") 100 can include a support element 120 (also referred to herein as "wedge support" or "wedge element"), a riser element 122 and an optional body element 124 (also referred to herein as a "body pillow"). As described above, the cushion system 100 can be used, for example, for the treatment of symptoms associated with GERD and/or other digestive disorders and/or other medical conditions. For example, the cushion system 100 can allow the user to sleep for an extended period of time in an inclined right-side lateral decubitus (RLD) position (as described in more detail below), which can minimize, or eliminate, gastro-esophageal reflux while facilitating the emptying of the stomach into the duodenum, or an inclined left-side lateral decubitus (LLD) position, which can facilitate the reduction of reflux episodes.

In some embodiments, the therapeutic cushion system 100 (also referred to herein as "cushion system") can be embodied or implemented as a mattress or cushion for a bed, for use by a user, for example, to sleep or rest in a flat (e.g., prone or supine) or an inclined position (e.g., a RLD or LLD position). In some embodiments, the cushion system 100 can be embodied as a mattress for an adjustable bed, such as, for example, a bed used in a medical facility. In some embodiments, the cushion system 100 can be embodied or implemented within a chair. For example, in some embodiments, the cushion system 100 can be implemented within a reclining chair such that a user can use the cushion system 100 in, for example, a seated position or a reclined position.

The support element 120 can have a variety of different shapes and/or sizes. In some embodiments, the support element has a wedge shape (e.g., in side view) or a portion that is wedge shaped. For example, the support element 120 can include an angled top surface (not shown in FIG. 1) or a portion of a top surface that is angled. In some embodiments, the angled top surface (or portion thereof) can be disposed, for example, at an angle between 6 degrees and 30 degrees relative to a bottom surface portion of the support member 120. Said another way, the support member 120 can have a height dimension that varies from a caudad end portion (also referred to herein as "first end portion") of the support element 120 to a cephalad end portion (also referred to herein as "second end portion") of the support element 120 (e.g., nearest the user's head), with the greatest height dimension being, for example, on the cephalad end portion of the support element 120. The support element 120 can include a concave or indented portion (not shown in FIG. 1) disposed on the top surface of the support element 120, for example, at or near the cephalad end as described in more detail below with reference to specific embodiments. The concave portion can be used, for example, to relieve pressure in the user's downside axilla when the user is lying in a lateral decubitus position on the cushion system 100.

The support element 120 can also have a shape that can promote an appropriate torso angle for a user to comfortably maintain a lateral decubitus position on the support element 120 during use. For example, the support element 120 can include a curved exterior portion that can help increase the comfort of a user lying in a lateral decubitus position for an extended period of time without uncomfortable pressure or pain in a downside shoulder or arm. In some embodiments, the support element 120 can include beveled corners on the cephalad end of the support element 120 that can accommodate additional ergonomic arm and elbow placement during use of the cushion system 100.

The support element 120 can include a cushion member 123 that can be disposed within an outer casing 121. The outer casing 121 of the support element 120 can be formed with one or more materials. For example, in some embodiments, the outer casing 121 can include a top portion on which the user contacts during use of the cushion system 100 that is formed with a first material, and a bottom portion that is formed with a second material. The top portion (e.g., the top surface) of the outer casing 121 can be formed with, for example, a four-way stretch material that is highly conformable, such as, for example, cotton/spandex, nylon/spandex, polyester/spandex or blends of any blend of cotton, nylon or polyester combined with spandex or elastane, and the bottom portion can be formed with a more robust material, such as, for example, poplin, canvas, gabardine or twill made using any combination of cotton, polyester or nylon, to provide durability.

In some embodiments, the outer casing 121 of the support element 120 can include an opening through which the cushion member 123 can be inserted and can include a fastener such as, for example, a zipper, buttons, snaps, flaps, hook and loop fasteners or other suitable coupling method to close or partially close the opening. The cushion member 123 can be formed with one or more foam materials, such as, for example, polyurethane or rubber latex, or visco-elastic polyurethane (e.g., memory foam). In some embodiments, the cushion member 123 can include multiple different foam materials each having a different density and/or a different deflection property. In alternative embodiments, the cushion member 123 can include one or more inflatable chambers. In other alternative embodiments, the cushion member 123 can include a filler material, such as a polyester material, disposed within an inner casing. In some embodiments, the support element 120 can include multiple cushion members 123. For example, multiple cushion members 123 can be stacked together within the outer casing 121.

The support element 120 can also optionally include other features and components, such as any of the various features and components described for a support element in co-pending U.S. Provisional Application Ser. No. 61/683,935, entitled "Therapeutic Cushion Systems and Methods," filed Aug. 16, 2012, (referred to herein as "the '935 application"), the disclosure of which is incorporated herein by reference in its entirety. For example, the support element 120 can include side bolster members or portions, non-slip surface features and patterns, an angled top surface, inflatable chambers, and/or stackable portions, as described in the '935 application.

The riser element 122 can be formed with or incorporated integrally with the support element 120 or can be formed separately and coupled to the support element 120 to form a body support member configured to support a user. For example, the riser element 122 can be coupled to (or formed integrally with) the support element 120 near or proximate the second end portion (i.e., cephalad end portion) of the support element 120 and can be used to support a neck and head of a user. The riser element 122 can include a cushion member 126 and an outer casing 127 in which the cushion member 126 can be disposed. The outer casing 127 can be formed the same as or similar to the outer casing 121 of the support element 120. The outer casing 127 of the riser element 122 can include an opening through which the cushion member 126 can be inserted and can include a fastener such as, for example, a zipper, buttons, snaps, flaps, hook and loop fasteners or other suitable coupling method to close or partially close the opening. The outer casing 127 can be formed with the same or similar materials as the outer casing 121 described above for the support element 120. For example, the outer casing 127 can include a first portion formed with a four-way stretch material and a second portion formed with a more robust material such as described for support element 120.

As with the cushion member 123, the cushion member 126 can be formed with one or more foam materials, such as, for example, polyurethane or rubber latex. In some embodiments, the cushion member 126 can include multiple different foam materials each having a different density. In other alternative embodiments, the cushion member 126 can include a filler material, such as a polyester material, disposed within an inner casing. In some embodiments, the riser element 122 can include multiple cushion members 126. For example, multiple cushion members 126 can be stacked together within the outer casing 127.

In some embodiments, a single outer casing (not shown in FIG. 1) can encase both the cushion member 123 of the support member 120 and the cushion member 126 of the riser element 122 and the pillow insert 125 (if included). For example, such an outer casing may be included in a cushion system 100 implemented within a bed. Such an outer casing can be formed with the same or similar materials as the outer casings 121 and 127 and can include the same or similar features. In some embodiments, the cushion member 123 of the support element 120 and the cushion member 126 of the riser element 122 can be formed as a single unitary cushion member and the outer casing can encase the cushion member.

The riser element 122 can also include a pillow insert 125 that can be disposed within the outer casing 127. For example, in some embodiments, the pillow insert 125 can be disposed within a pocket defined by the cushion member 126. In some embodiments, the pillow insert 125 can be disposed on top of the cushion member 126. The pillow insert 125 can include an inner casing (not shown in FIG. 1) that can contain a filler material (not shown in FIG. 1) therein. The filler material can be, for example, a clustered polyester fiber material, such as, for example, any combination of polyester fibers, clustered polyester fiber, down alternative made from synthetic fibers, polystyrene beads/pellets, shredded foam, or down feathers. The inner casing of the pillow insert 125 can also be formed with a four-way stretch material as described above for the outer casing 127. The inner casing of the pillow insert 125 can also include an opening through which the filler material can be inserted, and can include a fastener such as, for example, a zipper, buttons, snaps, or other suitable coupling method to close or partially close the opening. In alternative embodiments, the inner casing may not include such an opening. For example, after the filler material has been inserted into the inner casing, the inner casing can be closed with, for example, stitching.

The four-way stretch material of the outer casing 127 of the riser element 122 described above, in conjunction with the pillow insert 125 having an inner casing formed with the four-way stretch material and having a clustered polyester fiber filler material can allow the riser element 122 to be malleable and shape-retaining. For example, in such an embodiment, the user can conform the riser element 122 to a desired thickness and/or shape for that user's needs and preference. For example, the user can conform or adjust the riser element 122 to form cavities or to otherwise fit or conform to the user's face, ear, arm, etc. The conformed shape can be maintained for an extended time period and/or until the user disperses the filler material of the pillow insert 125 by, for example, shaking or fluffing the riser element 122.

The riser element 122 and the support element 120 can collectively define one or more receiving portions (not shown in FIG. 1). The receiving portion(s) can be, for example, an opening, void, cavity, pocket, space or gap, etc. between the support element 120 and the riser element 122, in which a user can insert at least a portion of the user's arm. In some embodiments, the receiving portion can be defined by flexible or conformable portions of the cushion system 100 such that the size of the receiving portion can vary as the user inserts an arm. For example, in some embodiments, a portion of the support member 120 can contact a portion of the riser element 122 such that as the user inserts an arm into the receiving portion, the user moves or flexes a portion of the support element 120 and/or a portion of the riser element 122.

The support element 120 and the riser element collectively can be a variety of different lengths, widths and/or thicknesses. For example, in some embodiments in which the cushion system 100 is implemented in a bed, the support element 120 and the riser element 122 collectively can have a length and width corresponding to a typical bed size, such as, for example, a twin size bed, a full size bed, a queen size bed, a king size bed, or a California king size bed. The riser element 122 and the support element 120 can also each individually be a variety of different lengths, widths and/or thicknesses. For example, a cushion system 100 can have a length and a portion of that length that is the support member 120 and the portion that is the riser element 122 can each vary. In some embodiments, such as a chair embodiment, the support element 120 and the riser element 122 can collectively define a back support portion of the chair.

In some embodiments, the riser element 122 can be movable relative to the support element 120 between a first configuration and a second configuration. For example, in some embodiments, the riser element 122 can be slidably moved between a first position and a second position. In some embodiments, the riser element 122 can be moved between a first position in which a portion of the riser element 122 is disposed within the receiving portion of the cushion system, and a second position in which the riser element 122 is disposed outside of the receiving portion enabling a user to place a portion of the user's arm and/or shoulder within the receiving portion. Such embodiments are described in more detail below with reference to specific embodiments.

The body element 124 can include a pillow insert 129 that can be disposed within a sleeve member 131. The sleeve member 131 can include an opening or openings through which the pillow insert 129 can be inserted, and can include a fastener such as, for example, a zipper, buttons, snaps, or other suitable coupling method to close or partially close the opening(s). The pillow insert 129 can be formed the same as or similar to the pillow insert 125 described above for the riser element 122. For example, the pillow insert 129 can include an inner casing (not shown in FIG. 1) containing a filler material (not shown in FIG. 1). The filler material can be, for example, a clustered polyester fiber material, such as, for example, the materials described above for the riser element 122. The inner casing of the body element 124 can be formed with, for example, a four-way stretch material as described above for the inner casing of the riser element 122. The sleeve member 131 can be formed with, for example, a four-way stretch material as described above for the riser element 122 and the support element 120, or can be constructed of a two-way stretch material, such as, for example, jersey or interlock. Thus, as described above for the riser element 122, the body element 124 can also be manipulated, conformed, adjusted, dispersed, etc., to conform to a desired shape and/or thickness. The inner casing of the pillow insert 129 can also include an opening through which the filler material can be inserted, and can include a fastener such as, for example, a zipper, buttons, snaps, or other suitable coupling method to close or partially close the opening. In alternative embodiments, the inner casing may not include such an opening. For example, after the filler material has been inserted into the inner casing, the inner casing can be closed with, for example, stitching.

The body element 124 can have a variety of different shapes and be a variety of different sizes. For example, in some embodiments, the body element 124 can include an arc portion at a cephalad end connecting a first arm and a second arm of the body element 124. In some embodiments, the arc portion can have a curvature of, for example, substantially 180 degrees. In other embodiments, the are portion can have a different curvature, for example, between about 30 degrees and 180 degrees. In some embodiments, the first arm and the second arm can extend parallel to each other away from the arc portion. In some embodiments, the first arm of the body element 124 can have a length that is about half a length of the second arm of the body element 124. In some embodiments, the first arm can be substantially the same length as the second arm. The body element 124 can also include various shapes and features as described for embodiments of a body element in the '935 application incorporated by reference above. The body element 124 can be reconfigurable into a variety of different shapes and configurations for use on the support element 120 and/or riser element 122 as described in more detail below. Optionally, in some embodiments, the body element 124 can be used independently of the support element 120 and the riser element 122.

The sleeve member 131 of the body element 124 can be formed in a tubular shape such that the pillow insert 129 can be inserted therein through an opening defined on one end of the sleeve member 131. The sleeve member 131 can include stitching along a single outer edge such that the body element 124 can be free of stitching along an inner edge portion of the sleeve member 131 where a user typically contacts the sleeve member 131 during use. Such an embodiment can provide increased comfort for the user as many known body pillows that have such inner stitching can tend to become taut when tension is applied, resulting in an awkward and potentially painful fit for the user. In addition, the stitching being along an outer edge portion the sleeve member 131 can eliminate or reduce distortion of the body element 124 during use, which can further provide improved feel and comfort to the user. In some embodiments, stitching can be included on the body element 124 at additional targeted areas of the body element 124 as described, for example, in the '935 application incorporated by reference above. The inner casing of the pillow insert 129 of the body element 124 can also be constructed in a tubular shape in the same or similar manner as the sleeve member 131. For example, the inner casing of pillow insert 129 can include stitching along an outer edge of the inner casing, and be free of stitching along an inner edge.

As described above, the user can manipulate, conform, disperse, etc., the clustered polyester fiber filler material within the body element 124 and/or the riser element 122 to create cavities or bulges to accommodate specific body parts and/or portions to accommodate the user's needs and/or preferences. The shape and/or cavity formed by the user can be maintained for an extended time period and/or until the user disperses the filler material of the riser element 122 and/or the body element 124 by, for example, shaking the riser element 122 and/or body element 124. The combination of the four-way stretch material and clustered polyester filler material can allow for the redistribution of the filler material in an equalized manner throughout the body element 124 and/or riser element 122. The reconfigurable filler material of the body element 124 and/or the riser element 122 can also minimize undesirable and irreversible migration of the filler material, which can occur in some known cushion systems due to their non-pliable stuffing and non-stretch material. In addition, the clustered polyester fiber filler material of the body element 124 and/or the riser element 122 can be machine washed and dried without causing clumping of the filler material. The combination of the filler material and the four-way stretch outer casing 127 and inner casing of pillow insert 125 of the riser element 122, and sleeve member 131 and inner casing of the pillow insert 129 of the body element 124, provides for post-laundering redistribution of the filler material to substantially its original state.

The cushion system 100 can be placed on a frame member or other support structure or can be placed on a floor surface for use. For example, when implemented in a bed embodiment, the cushion system 100 can be placed on a bed frame. In some such embodiment, support legs or feet and/or or wheels, such as castors, can be coupled to such a frame member. In some embodiments, the cushion system 100 can include one or more inflatable chambers that can allow a user to adjust a height and/or firmness of the cushion system 100. For example, the support element 120 and/or the riser element 122 can include one or more inflatable chambers. In some embodiments, the cushion system 100 can include a side support member or portion (not shown in FIG. 1) that can be used as an alternative to the body element 124.

In some embodiments, the cushion system 100 can include stackable elements. For example, in some embodiments, the support element 120 can include multiple separate stackable cushion members and the riser element 122 can include multiple stackable cushion members. In some embodiments, the cushion system 100 can include multiple stackable elements that each include a support element portion and riser element portion formed as a single component.

In one example use of the cushion system 100, the body element 124 can be positioned on the support element 120 or with a portion of the body element 124 on the support element 120 and a portion on the riser element 122. The user can then lie on or otherwise position the user's body on the cushion system 100, for example, in an inclined or reclined RLD or LLD position such that the user is aligned in approximately a center portion of the support element 120. The user can insert the user's right or left arm beneath the body element 124 and within the receiving portion formed between the support element 120 and the riser element 122. Optionally, the user can adjust the position of the user's right or left arm and shoulder within the receiving portion between the support element 120 and the riser element 122, such that user's downside axilla rests within the centered concave portion of the support element 120.

With the user's arm within the receiving portion between the support element 120 and the riser element 122, the cushion system 100 can maintain the user in the inclined or reclined RLD or LLD position. Thus, the tendency of the user to slide down an angled portion (if included) of the support member 120 can be reduced or eliminated. Further illustrations and details of how a user can be positioned on the cushion system 100 are described in the '935 application incorporated by reference above. In some embodiments, the support element 120 and the riser element 122 can be used without the use of the body element 124. In some embodiments, use of only the body element 124 may be desirable.

As described above, during use of the cushion system 100, a user can place a downside shoulder and arm within the receiving portion of the cushion system 100 when lying in a side position. In some embodiments, insertion of the user's arm within the receiving portion between the support element 120 and the riser element 122 can also mitigate the tendency of the user from sliding downward on an angled top surface portion of the support element 120 and can help stabilize the user in the lateral or side position during use of the cushion system 100. A position of the user's arm and shoulder can be adjusted within the receiving portion between the support element 120 and the riser element 122, such that user's downside axilla rests within the concave portion of the support element 120.

As described above, the cushion system 100 can be used as a method of treatment for GERD and/or other digestive disorders. To use the cushion system 100 for this purpose, the user can follow the steps described above for being positioned on the cushion system 100 in an inclined or reclined RLD position or an inclined or reclined LLD position. For example, in the inclined or reclined RLD position, the therapeutic cushion system 100 can serve to minimize, or eliminate, gastro-esophageal reflux while it facilitates the emptying of the stomach into the duodenum. For example, in the inclined or reclined RLD position, the exit valve (i.e., the pyloric sphincter) of the user's stomach will be positioned substantially at a bottom right side of the user's abdomen below or at an elevation lower than an elevation of the user's esophageal sphincter. Thus, when the user remains in the inclined or reclined RLD position for a sufficient period of time, the stomach contents of the user can drain out of the stomach and into the duodenum. For example, a time period between about 1-4 hours may be needed to empty the contents of the stomach into the duodenum such that the user feels relief from symptoms associated with GERD and/or other digestive disorders. The time frame can vary depending on various factors such as for example, the user's overall health, other conditions the user may have such as diabetes, or gastroparesis, or the type and amount of food the user has consumed prior to resting on the cushion system, etc. In another example, in the inclined or reclined LLD position, a reduction in the frequency of reflux episodes of the user can result.

FIGS. 2-7 illustrate an embodiment of a therapeutic cushion system that is implemented as a mattress or cushion to use, for example, as a bed. The therapeutic cushion system is shown as a twin-sized bed or mattress, but it should be understood that a cushion system can be implemented in other sizes, such as a full, queen, king, etc. A therapeutic cushion system 200 (also referred to herein as a "cushion system") includes a support element 220, a riser element 222 and can optionally include a body element 224 (see FIGS. 5 and 6). The support element 220, riser element 222 and optional body element 224 can each be configured and constructed the same as or similar to, and can function the same as or similar to, the support element 120, riser element 122, and body element 124 described above with respect to FIG. 1. Thus, some details are not described below with respect to support element 220, riser element 222 and/or the body element 224.

In this embodiment, the support element 220 and the riser element 222 are formed as a single component and collectively form a body support member configured to support a user. The support element 220 and the riser element 222 define a receiving portion 258 between the support element 220 and the riser element 222. The receiving portion 258 can be used as a shoulder relief area for the user to place a portion of a user's arm and/or shoulder when using the cushion system 200. In this embodiment, the support element 220 includes a top surface 240 that is substantially parallel to a bottom surface 239. Similarly, the riser element 222 includes a top surface 217 that is substantially parallel to a bottom surface 218 that is continuous with the bottom surface 239 of the support element 220.

The support element 220 has a first end portion 215 (also referred to as caudad end portion) and a second end portion 216 (also referred to herein as cephalad end portion) and includes a cushion member 223 (see FIG. 4) disposed within an outer casing 261. The support element 220 also includes a concave portion 230 and angled or beveled corners 233 at the second end portion 216. The cushion member 223 can be formed with, for example, one or more foam materials as described above for support member 120.

The riser element 222 includes a pillow insert 225 (see FIGS. 2 and 3) and a riser cushion member (not shown) that can be formed integrally or separately with the cushion member 223. The riser cushion member can be formed with the same or different materials as the cushion member 223 of the support member 220.

The outer casing 261 can also encase the riser cushion member and the pillow insert 225. In other words, a single outer casing 261 can be used. The pillow insert 225 can be disposed, for example, within a pocket (not shown) formed in the riser cushion member or can be disposed on top of the riser cushion member. The pillow insert 225 can include an inner casing (not shown) and filler material (not shown) as described above for pillow insert 125 such that the riser element 222 can include a compliant region to allow a user to form cavities or bulges to accommodate specific body parts and/or portions to accommodate the user's needs and/or preferences.

Figure 5:
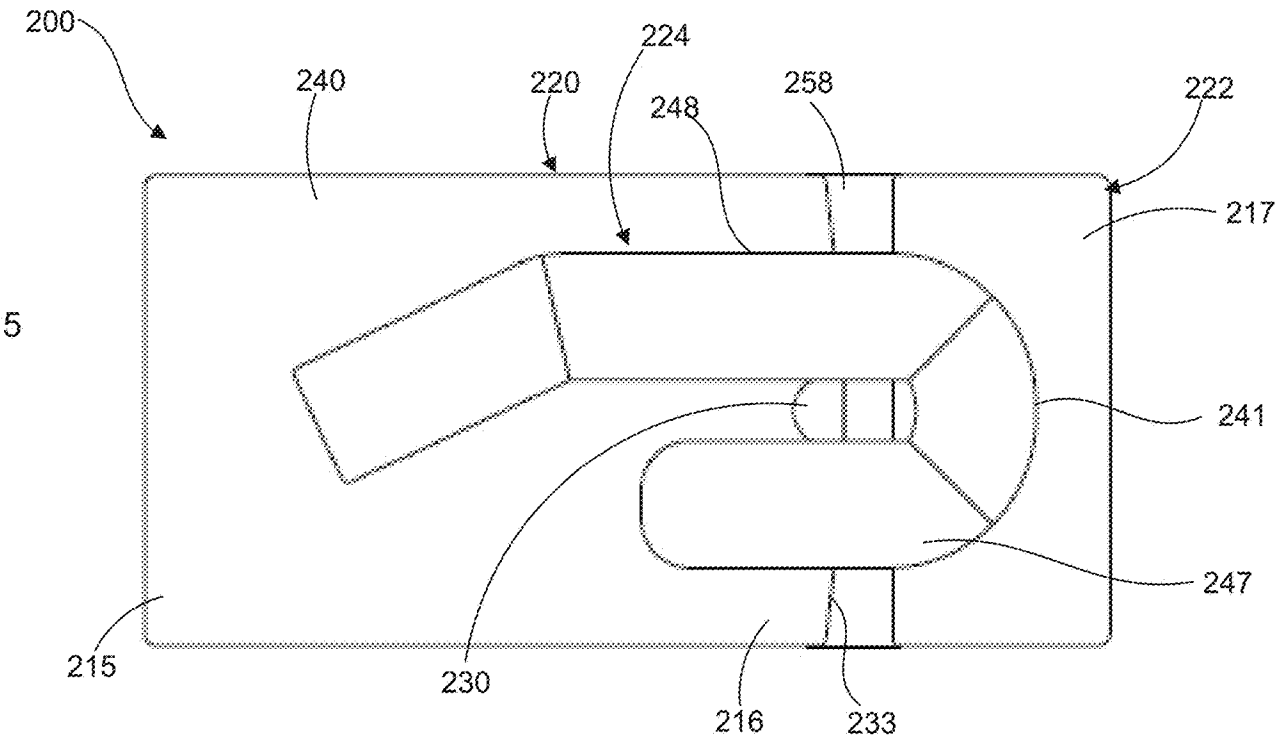
FIG. 5 is a top view of the therapeutic cushion system of FIG. 2 including an optional body element.
Figure 6:
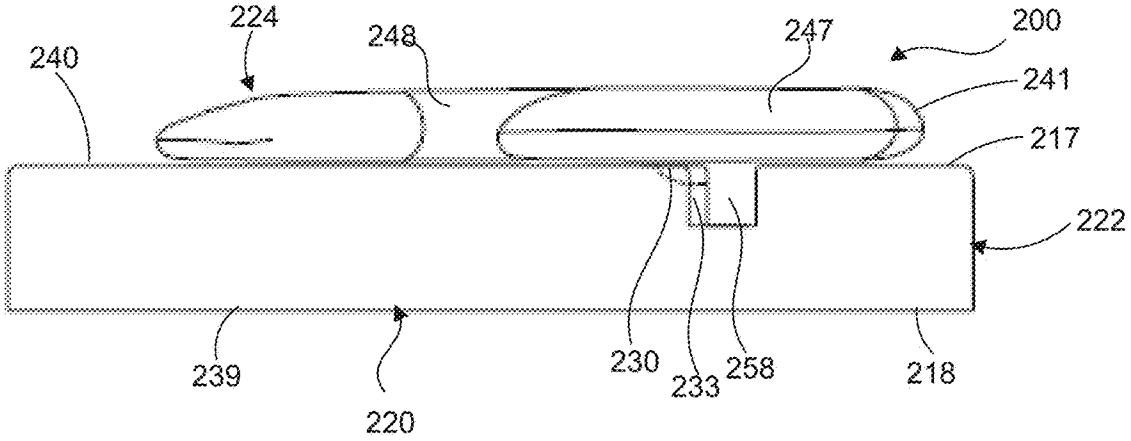
FIG. 6 is a side view of the therapeutic cushion system of FIG. 5.
Figure 7:
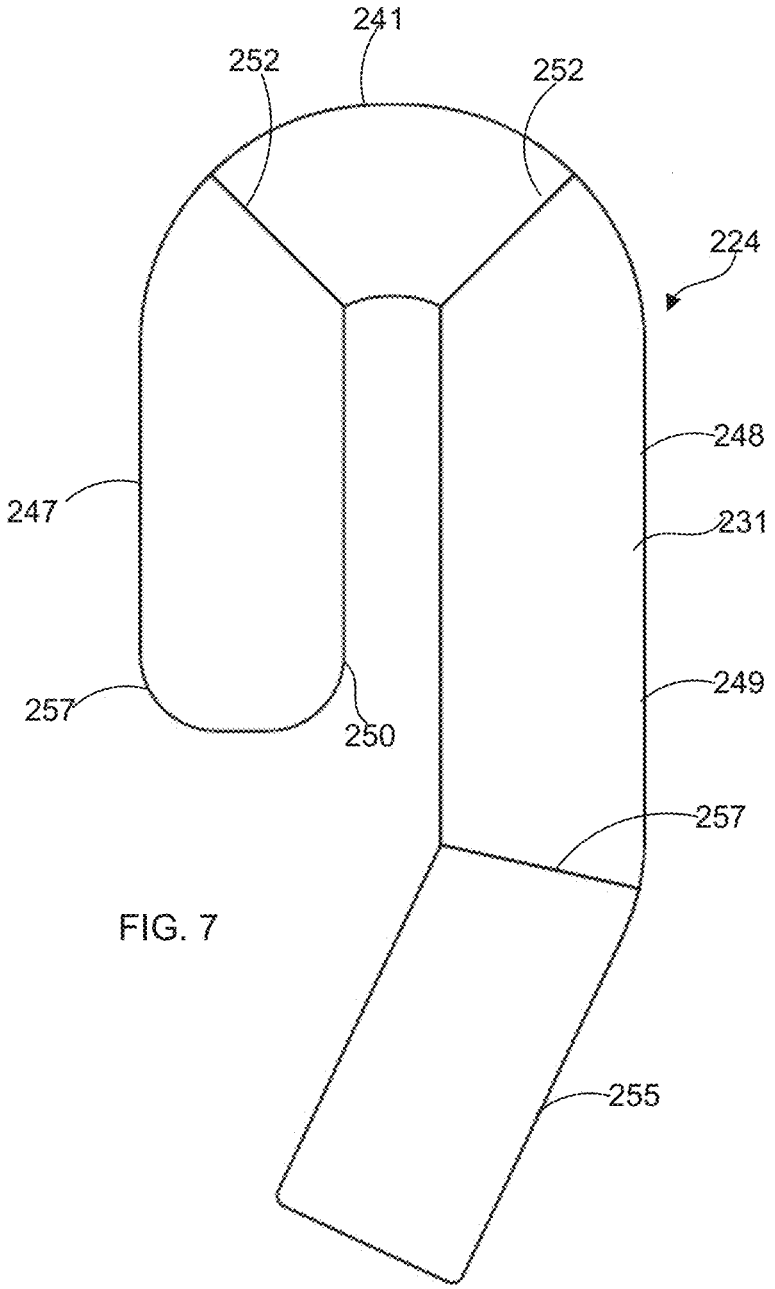
FIG. 7 is a front view of the body element of FIGS. 5 and 6.

FIGS. 5 and 6 illustrate the cushion system 200 with the optional body element 224. The body element 224 can be formed the same as or similar to, and function the same as or similar to, the body element 124 described above. As shown in FIG. 7, the body element 224 includes an arc portion 241 that has a substantially 180 degree curvature at a cephalad end portion, a first arm 247 and second arm 248 each extending from the arc portion 241 in a caudad direction. In this embodiment, the first arm 247 has a length that is shorter than a length of the second arm 248. For example, the first arm 247 can have a length, for example, about half a length of the second arm 248. The body element 224 is reconfigurable into a variety of different shapes for use on the support element 220 and/or riser element 222.

The body element 224 also includes a sleeve member 231 that has an inner edge portion 250 and an outer edge portion 249 in which a pillow insert (not shown) (e.g., such as pillow insert 129 described above) can be disposed. The pillow insert forms the shape of the arc portion 241 the first arm 247 and the second arm 248. In this embodiment, the second arm 248 includes an end portion 255 that is disposed at an angle relative to a remainder of the second arm 248. The end portion 255 can be disposed, for example, at an angle of up to about 25 degrees. A stitching feature 256 can be disposed at the start of the bend portion 255. The first arm 247 includes a rounded or curved end portion 257, and the end of the end portion 255 can optionally be similarly rounded.

The tubular shape of the sleeve member 231 can be formed, for example, by sewing or stitching along the outer edge portion 249 of the sleeve member 231. Thus, the sleeve member 231 can be free of stitching along an inner edge portion 250 of the sleeve member 231 where a user typically contacts the sleeve member 231 during use. As described above, having the inner edge portion 250 free of stitching can provide increased comfort for the user and can eliminate or reduce distortion of the body element 224 during use. In this embodiment, the sleeve member 231 also includes stitching features 252 that extend at an angle from the inner edge portion 250 to the outer edge portion 249. The stitching 252 can extend, for example, at a 45 degree angle.

As shown in FIGS. 5 and 6, the body element 224 can be positioned with a portion of the body element 224 disposed on the riser element 222 and a portion of the body element 224 disposed on the support element 220. The cushion system 200 can be used in the same or similar manner as described above for cushion system 100. For example, to use the cushion system 200, the user can lie on the cushion system 200 in a substantially flat RLD or LLD position depending on the particular needs of the user, such that the user is aligned in approximately a center portion of the support element 220 with the user's right or left arm disposed within the receiving portion 258. For example, the user can insert the user's right arm below the arc portion 241 of the body element 224 and within the receiving portion 258 and extend the arm to the other side of the first arm 247 of the body element 224. In this manner, the user's arm and/or shoulder can be within the receiving portion 258 and the user's downside axilla can rest within the centered concave portion 230 of the support element 220. The user can then place the second arm 248 between the user's legs and tuck the second arm 248 under the user's hips and buttocks. The user can optionally use a separate pillow (not shown) on top of the riser element 222 to provide further head and neck support if desired.

Figure 8:
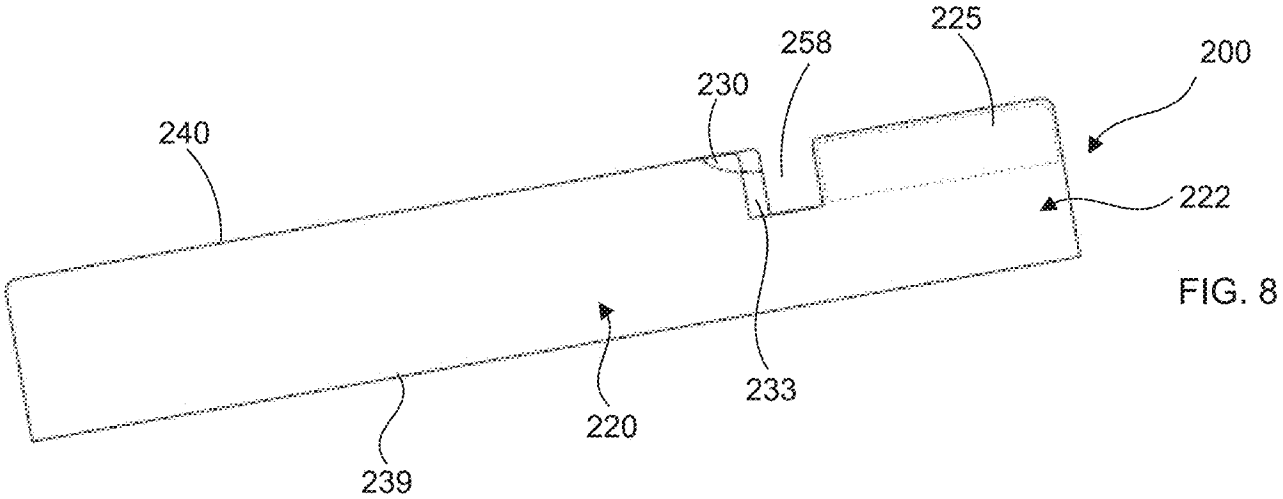
FIG. 8 is a side view of the therapeutic cushion system of FIG. 2 shown in an inclined position.

FIG. 8 is an illustration of the cushion system 200 shown in an inclined position. For example, it may be desirable to place the cushion system 200 on an inclined bed support or frame, such that a user can be placed in an inclined position when using the cushion system 200. Such a use may be desirable, for example, on an adjustable bed, such as, for example, a bed used in a medical facility.

Figure 9:
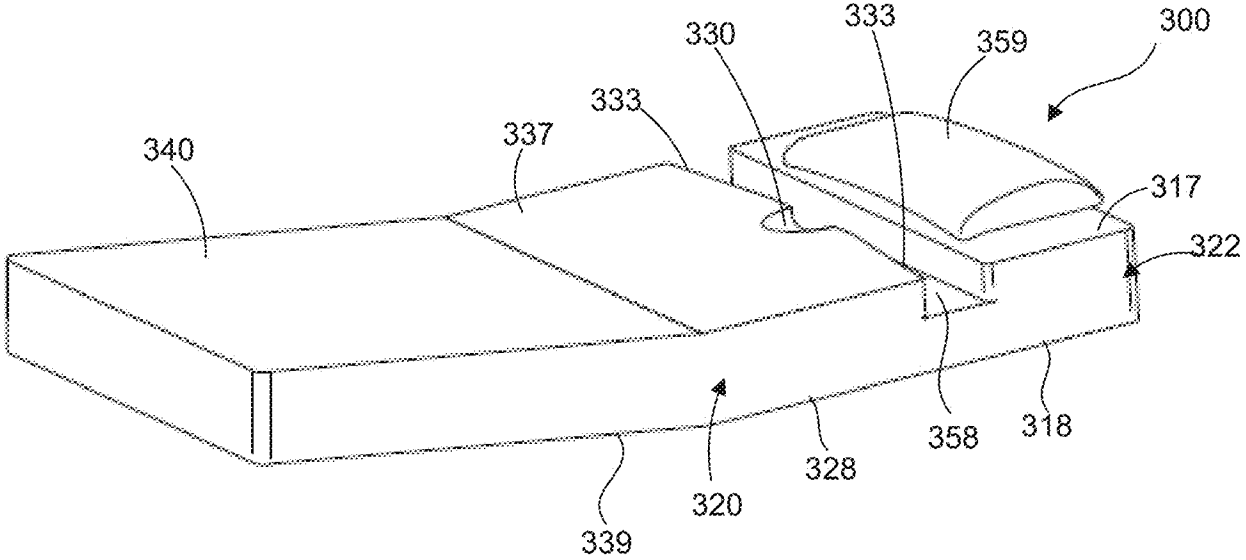
FIG. 9 is a side perspective view of a therapeutic cushion system, according to another embodiment.
Figure 10:
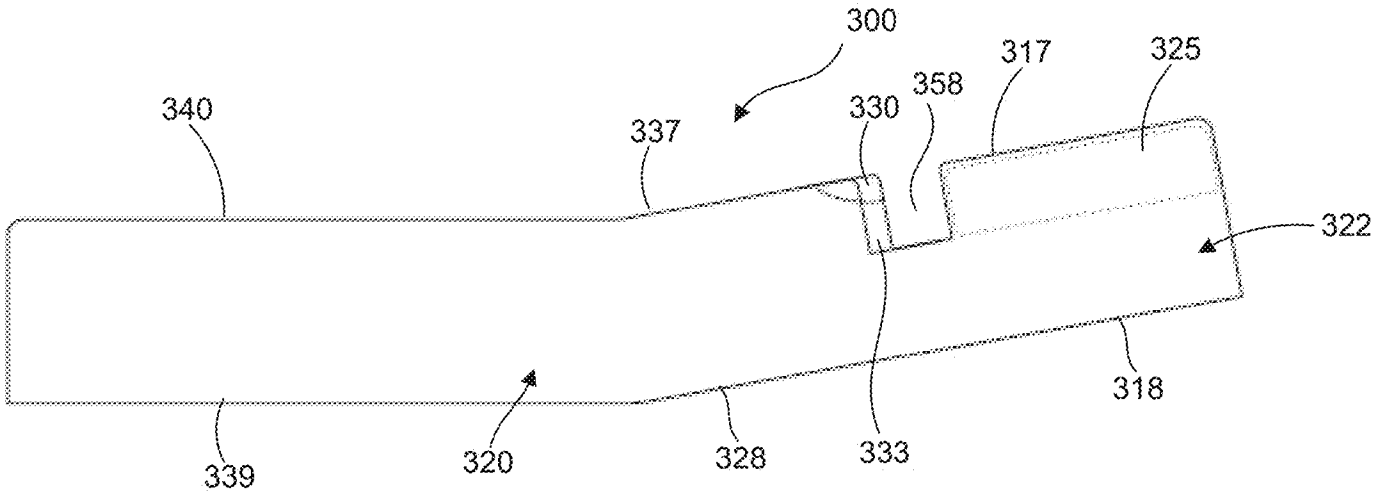
FIG. 10 is a side view of the therapeutic cushion system of FIG. 9.
Figure 11:
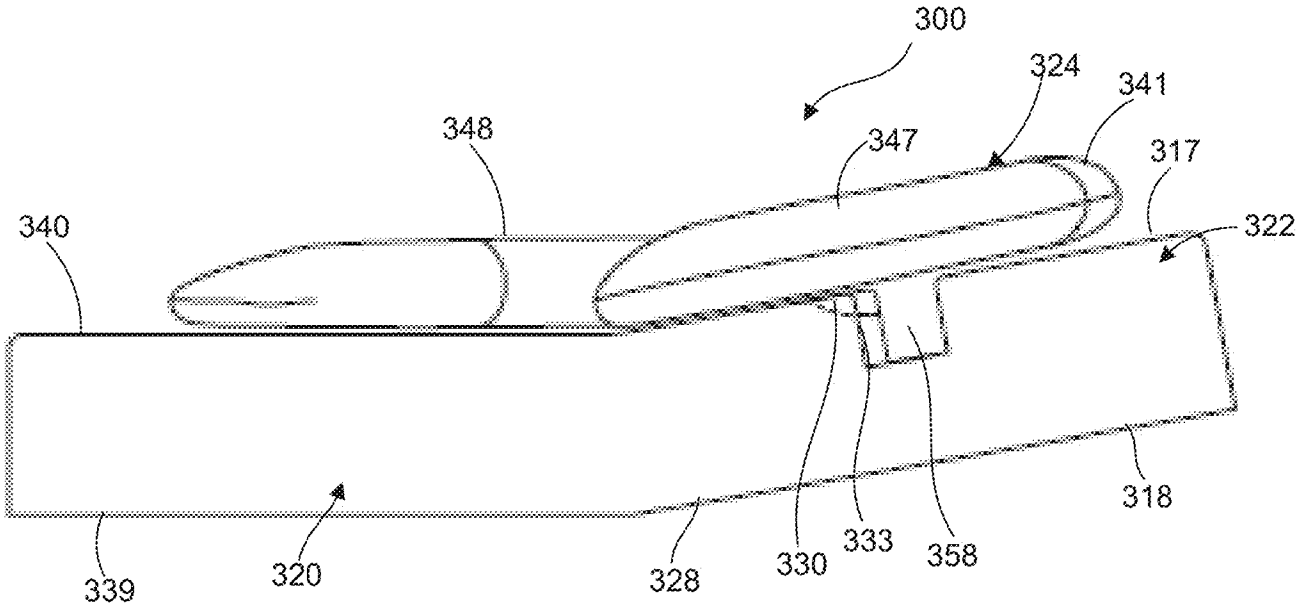
FIG. 11 is a side view of the therapeutic cushion system of FIG. 9 with an optional body element.
Figure 12:
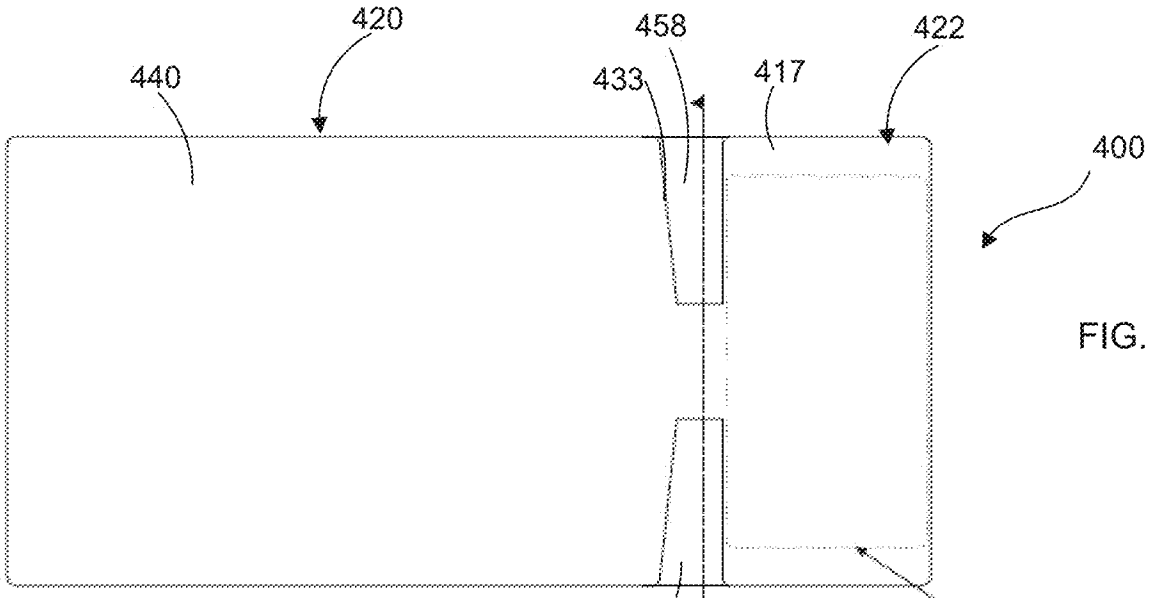
FIG. 12 is a top view of a therapeutic cushion system, according to another embodiment.
Figure 14:
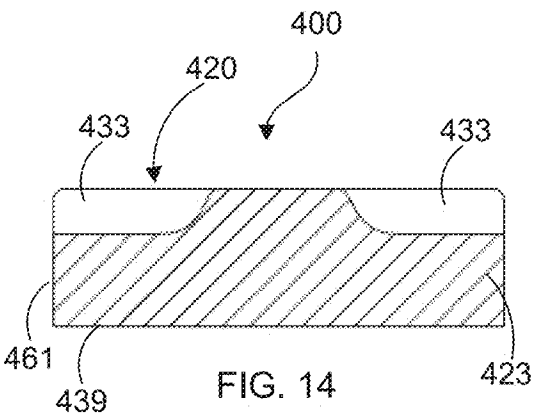
FIG. 14 is a cross-sectional view of the therapeutic cushion system of FIG. 12 taken along line A-A shown in FIGS. 12 and 13.
Figure 13:
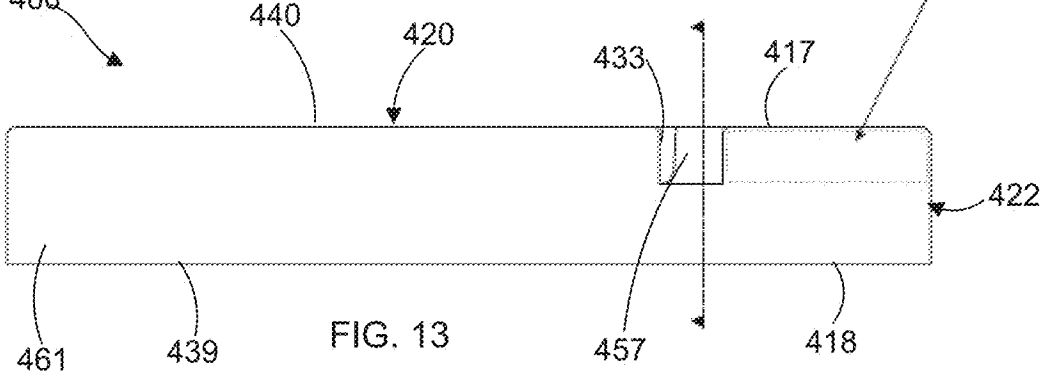
FIG. 13 is a side view of the therapeutic cushion system of FIG. 12.

FIGS. 9-11 illustrate another embodiment of a therapeutic cushion system implemented as a mattress or cushion for a bed. A therapeutic cushion system 300 (also referred to herein as "cushion system") includes a support element 320, a riser element 322 and an optional body element 324 (shown in FIG. 11). The cushion system 300 can be constructed the same as or similar to, and can function the same as or similar to, the cushion systems 100 and 200 described above, and therefore, some details are not described below for cushion system 300.

In this embodiment, the support element 320 and the riser element 322 are constructed as a single component to form a body support member configured to support a user, and define a receiving portion 358 between the support element 320 and the riser element 322 that can be used as a shoulder relief area for the user to place a portion of a user's arm and/or shoulder when using the cushion system 300. In this embodiment, the support element 320 includes a first top surface portion 340 that is substantially parallel to a bottom surface portion 339 and a second top surface portion 337 that is disposed at an angle relative to the bottom surface portion 339. The second top surface portion 337 can be disposed relative to the first bottom surface portion 339 at an angle between, for example, about 6 degrees and about 30 degrees. The support element 320 also includes a second bottom surface portion 328 that is disposed at an angle relative to the first bottom surface portion 339 and substantially parallel to the second top surface portion 337.

The riser element 322 includes a top surface 317 that is disposed substantially parallel to a bottom surface 318 that is continuous with the bottom surface 328 of the support element 320. The top surface 317 is also disposed at an angle relative to the first bottom surface portion 339 and substantially parallel to the second bottom surface portion 328. For example, the top surface 317 can be disposed relative to the first bottom surface portion 339 at an angle between, for example, about 6 degrees and about 30 degrees.

The support element 320 can include a cushion member (not shown) disposed within an outer casing 361, a concave portion 330 and angled or beveled corners 333 as described above for support element 220. The cushion member of the support element 320 can be formed with, for example, one or more foam materials as described above for previous embodiments. The riser element 322 can include a pillow insert 325 (see FIG. 10) and a riser cushion member (not shown) that can be formed integrally or separately with the cushion member of the support element 320. The riser cushion member can be formed with the same or different materials as the cushion member of the support element 320. The outer casing 361 can also encase the pillow insert 325 and the riser cushion member as described above.

The pillow insert 325 can be disposed, for example, within a pocket (not shown) formed in the riser cushion member or can be disposed on top of the riser cushion member. The pillow insert 325 can include an inner casing (not shown) and filler material (not shown) as described above for pillow insert 125 such that the riser element 322 can include a compliant region to allow a user to form cavities or bulges to accommodate specific body parts and/or portions to accommodate the user's needs and/or preferences.

The body element 324 (shown in FIG. 11) can be configured the same as or similar to the body element 224 or body element 124 described above, and can be positioned on the riser element 322 and the support element 320 as previously described for other embodiments. For example, the body element 324 can include an arc portion 341 that has a substantially 180 degree curvature at a cephalad end portion, a first arm 347 and second arm 348 each extending from the arc portion 341 in a caudad direction. The body element 324 can also be reconfigurable into a variety of different shapes for use on the support element 320 and/or riser element 322. The body element 324 can also include other features and components as described above for previous embodiments.

As shown in FIG. 11, the body element 324 can be positioned with a portion of the body element 324 disposed on the riser element 322 and a portion of the body element 324 disposed on the support element 320. The user can optionally use a separate pillow (not shown) on top of the riser element 322 to provide further head and neck support if desired. The cushion system 300 can be used in the same or similar manner as described above for cushion systems 100 and 200.

FIGS. 12-17 illustrate another embodiment of a therapeutic cushion system that is implemented as a mattress or cushion for a bed. A therapeutic cushion system 400 (also referred to herein as a "cushion system") includes a support element 420, a riser element 422 and can optionally include a body element 424 (see FIGS. 15 and 16). The support element 420, riser element 422 and optional body element 424 can each be configured and constructed the same as or similar to, and can function the same as or similar to, the support elements, riser elements, and body elements described above with respect to previous embodiments. Thus, some details are not described below with respect to support element 420, riser element 422 and/or the body element 424.

In this embodiment, the support element 420 and the riser element 422 are constructed as a single component to form a body support member configured to support a user, and collectively define a first receiving portion 457 and a second receiving portion 458 between the support element 420 and the riser element 422. The first and second receiving portions 457 and 458 can each be used as a shoulder relief area for the user to place a portion of a user's arm and/or shoulder when using the cushion system 400. In this embodiment, the support element 420 includes a top surface 440 that is substantially parallel to a bottom surface 439. Similarly, the riser element 422 includes a top surface 417 that is substantially parallel to a bottom surface 418 that is continuous with the bottom surface 439 of the support element 420.

The support element 420 can include a cushion member 423 (see FIG. 14) disposed within an outer casing 461 and angled or beveled corners 433 as described above for support element 220. The cushion member of the support element 420 can be formed with, for example, one or more foam materials as described above for previous embodiments. The riser element 422 can include a pillow insert 425 (see FIGS. 12 and 13) and a riser cushion member (not shown) that can be formed integrally or separately with the cushion member of the support element 420. The riser cushion member can be formed with the same or different materials as the cushion member of the support element 420. The outer casing 461 can also encase the pillow insert 425 and the riser cushion member as described above.

The outer casing 461 can also encase the riser cushion member and the pillow insert 425. The pillow insert 425 can be disposed, for example, within a pocket (not shown) formed in the riser cushion member or can be disposed on top of the riser cushion member. The pillow insert 425 can include an inner casing (not shown) and filler material (not shown) as described above for pillow insert 125 such that the riser element 422 can include a compliant region to allow a user to form cavities or bulges to accommodate specific body parts and/or portions to accommodate the user's needs and/or preferences.

Figure 15:
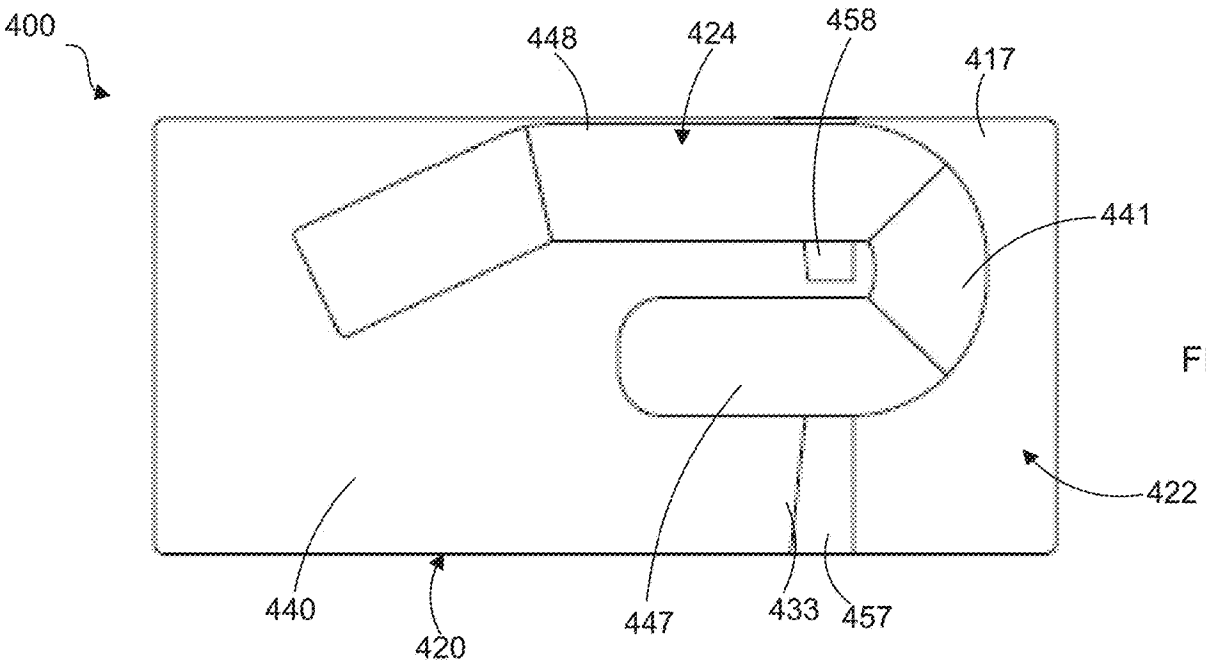
FIG. 15 is a top view of the therapeutic cushion system of FIG. 12 with an optional body element.
Figure 16:
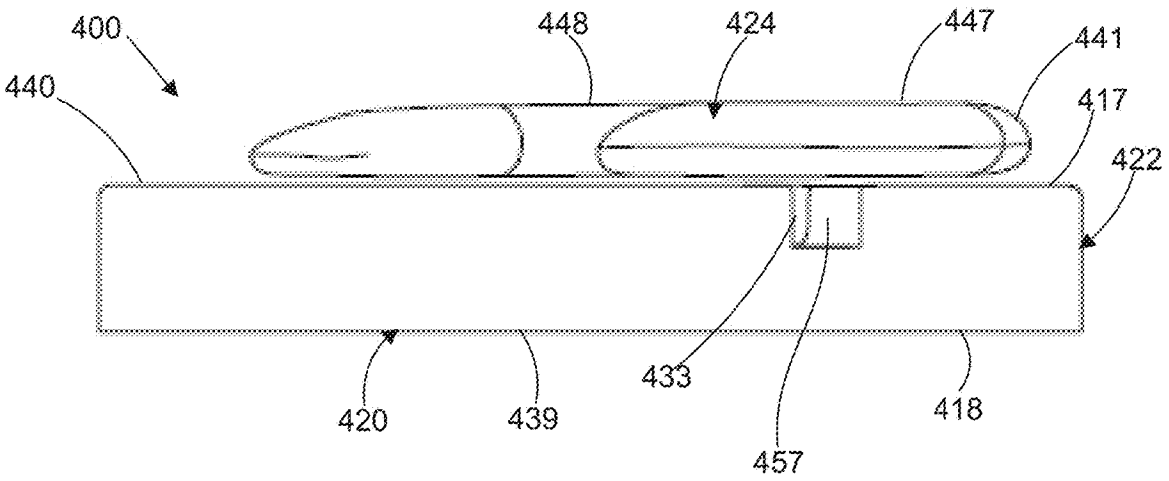
FIG. 16 is a side view of the therapeutic cushion system of FIG. 15.

FIGS. 15 and 16 illustrate the cushion system 400 with the optional body element 424. As shown in FIG. 15, the body element can be positioned on the riser element 422 and the support element 420 as previously described for other embodiments. The body element 424 can be formed the same as or similar to, and function the same as or similar to, the body elements described above. For example, the body element 424 can include an arc portion 441 that has a substantially 180 degree curvature at a cephalad end portion, a first arm 447 and second arm 448 each extending from the arc portion 441 in a caudad direction. The body element 424 can also be reconfigurable into a variety of different shapes for use on the support element 420 and/or riser element 422. The body element 424 can also include other features and components as described above for previous embodiments.

As shown in FIGS. 15 and 16, the body element 424 can be positioned with a portion of the body element 424 disposed on the riser element 422 and a portion of the body element 424 disposed on the support element 420. The cushion system 400 can be used in the same or similar manner as described above for cushion system 100. For example, to use the cushion system 400, the user can lie on the cushion system 200 in a substantially flat RLD or LLD position depending on the particular needs of the user, such that the user is aligned in approximately a center portion of the support element 420 with the user's right or left arm disposed within either the first receiving portion 457 or the second receiving portion 458. For example, the user can insert the user's right arm below the arc portion 441 of the body element 424 and within the receiving portion 458 and extend the arm to the other side of the first arm 447 of the body element 424. In this manner, the user's arm and shoulder can be within the receiving portion 458. The user can optionally use a separate pillow (not shown) on top of the riser element 422 to provide further head and neck support if desired.

Figure 17:
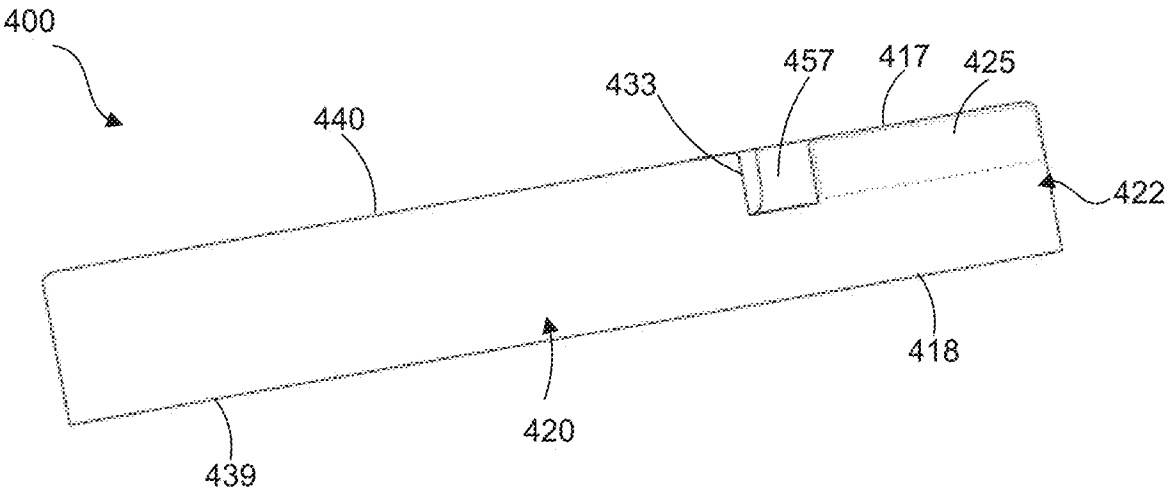
FIG. 17 is a side view of the therapeutic cushion system of FIG. 12 shown in an inclined position.

FIG. 17 is an illustration of the cushion system 400 shown in an inclined position. For example, it may be desirable to place the cushion system 400 on an inclined bed support or frame, such that a user can be placed in an inclined position when using the cushion system 400. Such a use may be desirable, for example, on an adjustable bed, such as, for example, a bed used in a medical facility.

Figure 18:
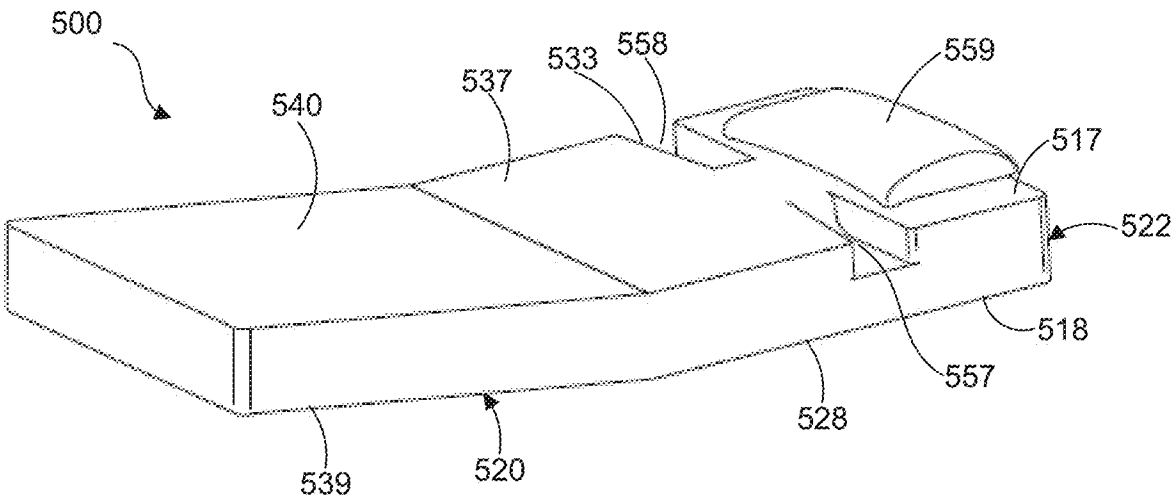
FIG. 18 is a side perspective view of a therapeutic cushion system, according to another embodiment.
Figure 19:
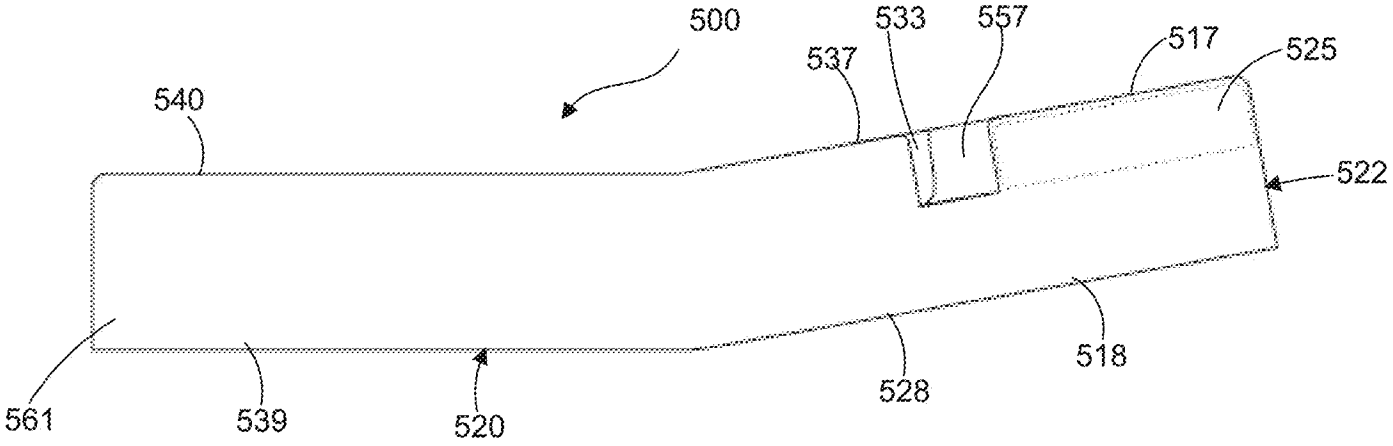
FIG. 19 is a side view of the therapeutic cushion system of FIG. 18.
Figure 20:
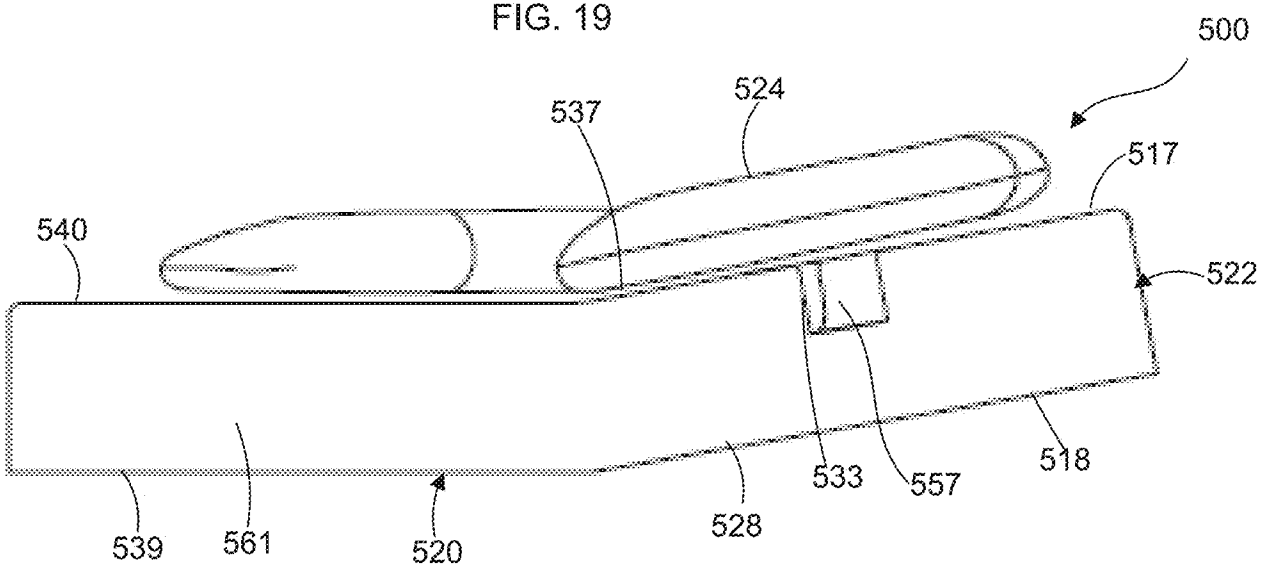
FIG. 20 is a side view of the therapeutic cushion system of FIG. 18 with an optional body element.

FIGS. 18-20 illustrate another embodiment of a therapeutic cushion system implemented as a mattress or cushion for a bed. A therapeutic cushion system 500 (also referred to herein as "cushion system") includes a support element 420, a riser element 422 and an optional body element 424 (shown in FIG. 20). The cushion system 500 can be constructed the same as or similar to, and can function the same as or similar to, the cushion systems described above, and therefore, some details are not described below for cushion system 500.

In this embodiment, the support element 520 and the riser element 522 are constructed as a single component and form a body support member configured to support a user. The support element 520 and the riser element 522 collectively define a first receiving portion 557 and a second receiving portion 558 between the support element 520 and the riser element 522 that can each be used as a shoulder relief area for the user to place a portion of a user's arm and/or shoulder when using the cushion system 500. In this embodiment, the support element 520 includes a first top surface portion 540 that is substantially parallel to a bottom surface portion 539 and a second top surface portion 537 that is disposed at an angle relative to the bottom surface portion 539. The second top surface portion 537 can be disposed relative to the first bottom surface portion 539 at an angle between, for example, about 6 degrees and about 30 degrees. The support element 520 also includes a second bottom surface portion 528 that is disposed at an angle relative to the first bottom surface portion 539 and substantially parallel to the second top surface portion 537.

The riser element 522 includes a top surface 517 that is disposed substantially parallel to a bottom surface 518 that is continuous with the second bottom surface 528 of the support element 520. The top surface 517 is also disposed at an angle relative to the first bottom surface portion 539 and substantially parallel to the second bottom surface portion 528. For example, the top surface 517 can be disposed relative to the first bottom surface portion 539 at an angle between, for example, about 6 degrees and about 30 degrees.

The support element 520 can include a cushion member (not shown) disposed within an outer casing 561 and angled or beveled corners 533 as described above for support element 420. The cushion member of the support element 520 can be formed with, for example, one or more foam materials as described above for previous embodiments. The riser element 522 can include a pillow insert 525 (see FIG. 19) and a riser cushion member (not shown) that can be formed integrally or separately with the cushion member of the support element 520. The riser cushion member can be formed with the same or different materials as the cushion member of the support element 520. The outer casing 361 can also encase the pillow insert 525 and the riser cushion member as described above.

The pillow insert 525 can be disposed, for example, within a pocket (not shown) formed in the riser cushion member or can be disposed on top of the riser cushion member. The pillow insert 525 can include an inner casing (not shown) and filler material (not shown) as described above for pillow insert 125 such that the riser element 522 can include a compliant region to allow a user to form cavities or bulges to accommodate specific body parts and/or portions to accommodate the user's needs and/or preferences.

The body element 524 (shown in FIG. 20) can be configured the same as or similar to the body elements described above for previous embodiments, and can be positioned on the riser element 522 and the support element 520 as previously described. As shown in FIG. 20, the body element 524 can be positioned with a portion of the body element 524 disposed on the riser element 522 and a portion of the body element 524 disposed on the support element 520. The user can optionally use a separate pillow (not shown) on top of the riser element 522 to provide further head and neck support if desired. The cushion system 500 can be used in the same or similar manner as described above for previous embodiments.

FIGS. 21-27 illustrate an embodiment of a therapeutic cushion system implemented within a reclining chair (also referred to as "recliner"). A therapeutic cushion system 600 (also referred to herein as "cushion system") includes a back portion 632, a seat portion 634 and a foot support portion 636. The back portion 632 includes a back support member 635 to which a support element 620 and a riser element 622 can be mounted or coupled. The support element 620 and the riser element 622 can each be constructed the same as or similar to, and can function the same as or similar to, the support elements and riser elements described above for previous elements, and therefore, some details are not described below for cushion system 600.

In this embodiment, the support element 620 and the riser element 622 are constructed as a single component and define a fixed receiving portion 658 between the support element 620 and the riser element 622 that can be used as a shoulder relief area for the user to place a portion of a user's arm and/or shoulder when using the cushion system 600. The support element 620 includes a concave portion 630 and angled portions 633 similar to the support elements described above. The support element 620 can include a cushion member (not shown) disposed within an outer casing 661 (see, e.g., FIG. 21). The cushion member of the support element 620 can include more than one cushion component and can be formed with, for example, one or more foam materials as described above for previous embodiments.

The riser element 622 includes a riser cushion member (not shown) that can be formed integrally or separately with the cushion member of the support element 620. The riser cushion member can be formed with the same or different materials as the cushion member of the support element 620. The outer casing 661 can also encase the riser cushion member as described above. The riser element 622 can also include a pillow insert (not shown). For example, the pillow insert 625 can be disposed, for example, within a pocket (not shown) formed in the riser cushion member or can be disposed on top of the riser cushion member. The pillow insert 625 can include an inner casing (not shown) and filler material (not shown) as described above for pillow insert 125 such that the riser element 622 can include a compliant region to allow a user to form cavities or bulges to accommodate specific body parts and/or portions to accommodate the user's needs and/or preferences.

Figure 21:
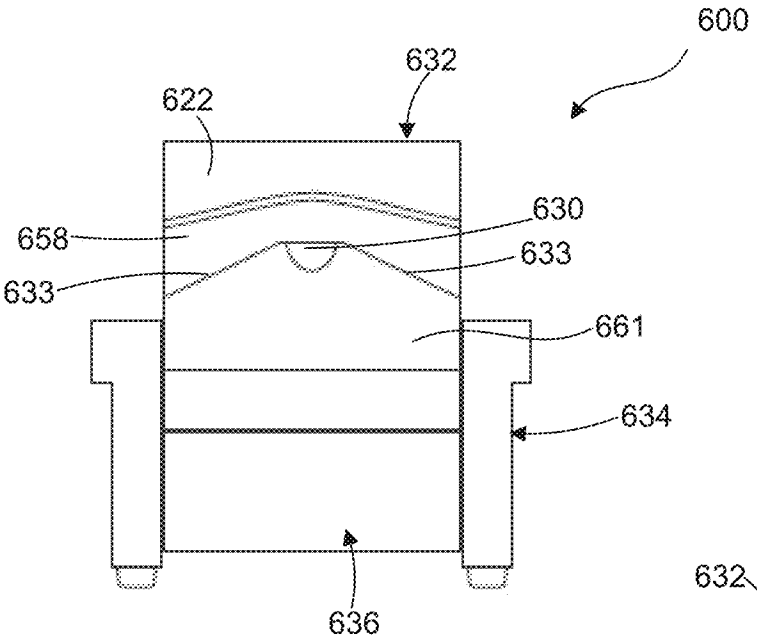
FIG. 21 is a front view of a therapeutic cushion system, according to another embodiment shown in a first configuration.
Figure 22:
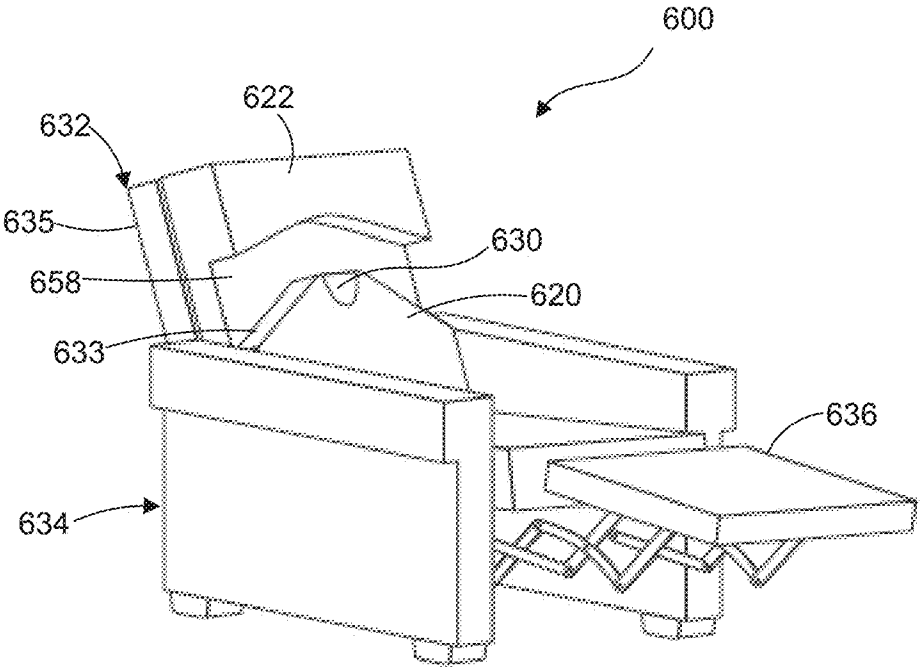
FIG. 22 is a side perspective view of the therapeutic cushion system of FIG. 21 shown in a second configuration.
Figure 23:
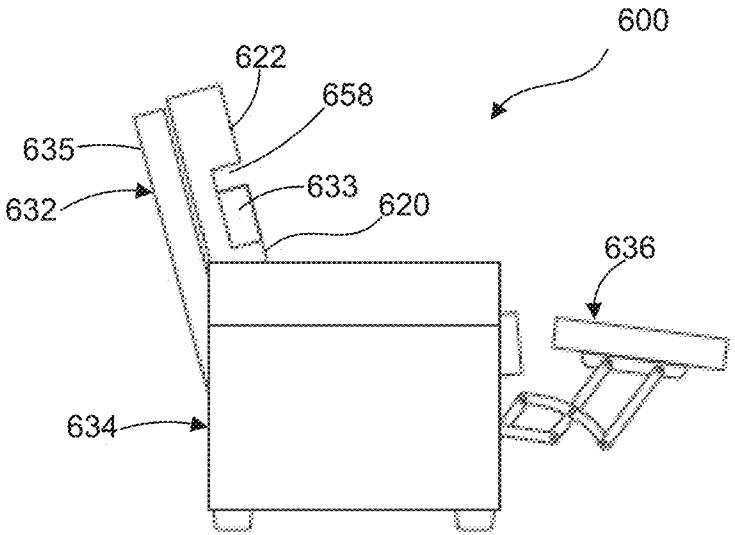
FIG. 23 is a side view of the therapeutic cushion system of FIG. 21 shown in the second configuration.
Figure 24:
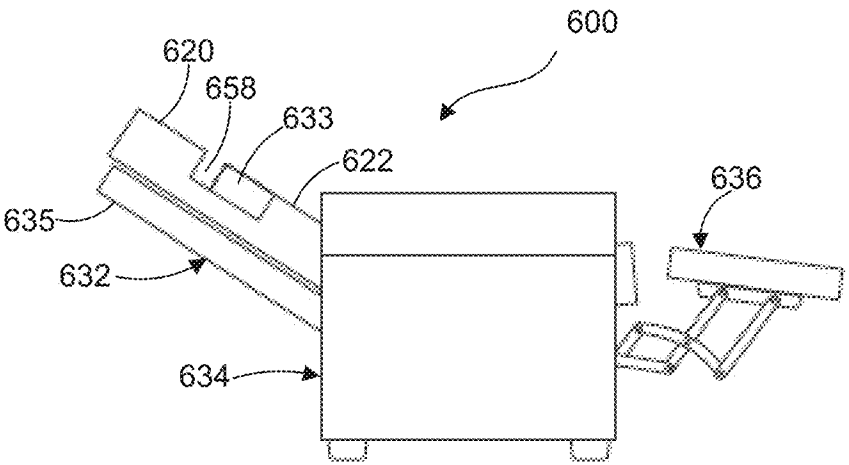
FIG. 24 is a side view of the therapeutic cushion system of FIG. 21 shown in a third configuration.

As with a typical recliner, the cushion system 600 has a substantially upright configuration, as shown, for example, in FIG. 21, in which the user can be disposed on the cushion system 600 in, for example, a substantially seated position. The cushion system 600 can be moved to various partially reclined configurations in which the back portion 632 is disposed at various angles relative to the seat portion 634, as shown, for example, in FIGS. 22 and 23, and a fully reclined position, as shown in FIG. 24. When the cushion system 600 is its partially reclined or fully reclined configurations, the foot support portion 636 can be used to support the feet and legs of the user. The cushion system 600 can include features included in a typical recliner that can be used to move the cushion system 600 between the various configurations. For example, the cushion system 600 can include a mechanism that can be actuated by a user with, for example, a handle (not shown).

Figure 26:
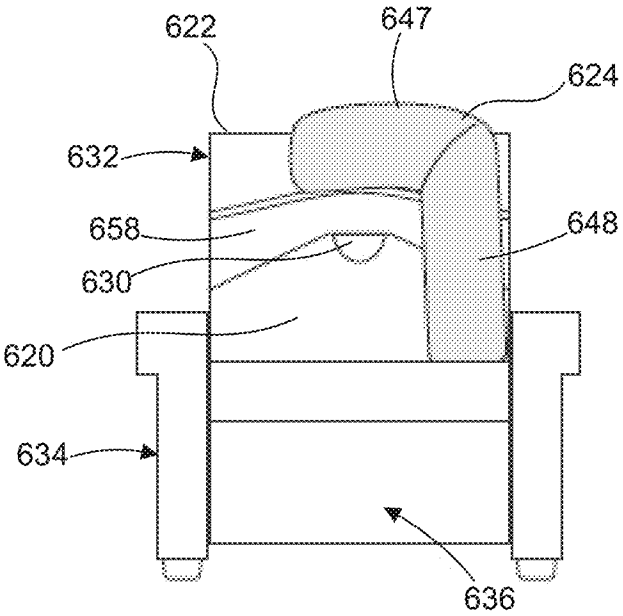
FIG. 26 is a front view of the therapeutic cushion system of FIG. 21 shown in the first configuration with the body element of FIG. 25.
Figure 25:
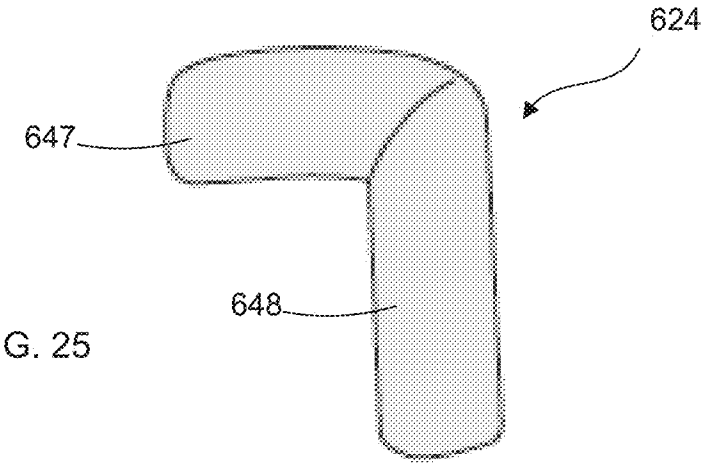
FIG. 25 is a front view of a body element, according to an embodiment.
Figure 27:
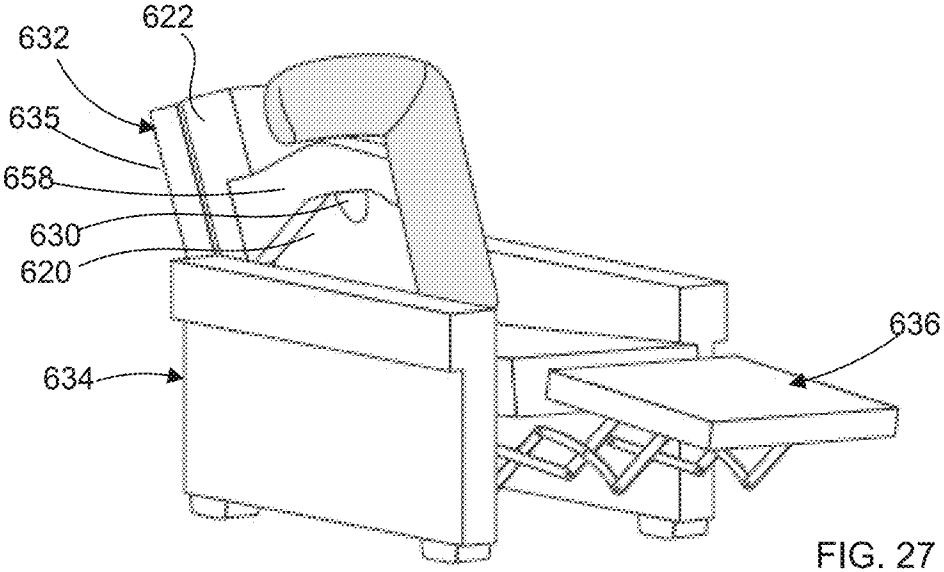
FIG. 27 is a side perspective view of the therapeutic cushion system of FIG. 21 shown in the second configuration with the body element of FIG. 25.

The cushion system 600 can also optionally include a body element 624, as shown in FIGS. 25-27 that can be constructed with the same or similar materials as described above for previous embodiments of a body element. As shown in FIGS. 25-27, the body element 624 includes a first arm 647 and a second arm 648 disposed substantially perpendicular to each other. In alternative embodiments, the first arm 647 and the second arm 648 can be disposed at a different angle relative to each other such as greater than or less than 90 degrees. The body element 624 can be disposed on the cushion system 600 as shown, for example, in FIGS. 26 and 27. For example, the body element 624 can be positioned such that a portion of the body element 624 is positioned in contact with the riser element 622 and a portion is positioned against the support element 620. The body element 624 can be used to maintain the user in a side position when using the cushion system 600. The user can optionally use a separate pillow (not shown) to provide further head and neck support if desired.

The cushion system 600 can be used in a similar manner as described above for previous embodiments. For example, the cushion system 600 can allow the user to sleep comfortably for an extended period of time in a substantially seated or a reclined position. The user can be positioned in a RLD position or LLD position as described above. Also as described above, when used in the reclined RLD position, the cushion system 600 can serve to minimize, or eliminate, gastro-esophageal reflux while it facilitates the emptying of the stomach into the duodenum of the user, and when the user is in a reclined LLD position, the cushion system can serve to reduce reflux episodes.

In one example use of the cushion system 600, the body element 624 can optionally be positioned on the cushion system 600 as described above and as shown in FIGS. 26 and 27. With the cushion system 600 in its first configuration (as shown in FIG. 21), the user can position the user's body on the cushion system 600 in a substantially seated position. The user can optionally move the cushion system 600 to a partially reclined configuration and optionally to a fully reclined configuration, as shown, for example, in FIG. 24. The user can position the user's body in a RLD or LLD position such that the user is aligned in approximately a center portion of the support element 620. The user can insert the user's right or left arm within the receiving portion 658 between the support element 620 and the riser element 622 to provide shoulder relief. As described above, in some embodiments, insertion of the user's arm within the receiving portion 658 between the support element 620 and the riser element 622 can also mitigate the tendency of the user from sliding downward on an angled back portion 632 and can help stabilize the user in the lateral or side position during use of the cushion system 600. Optionally, the user can adjust the position of the user's right or left arm and shoulder within the receiving portion 658 such that user's downside axilla rests within the centered concave portion 630 of the support element 620.

FIGS. 28-34 illustrate another embodiment of a therapeutic cushion system implemented within a reclining chair (also referred to as "recliner"). A therapeutic cushion system 700 (also referred to herein as "cushion system") includes a back portion 732, a seat portion 734 and a foot support portion 736. The back portion 732 includes a back support member 735 to which a support element 720 and a riser element 722 can be mounted or coupled. The support element 720 and the riser element 722 can each be constructed the same as or similar to, and can function the same as or similar to, the support elements and riser elements described above for previous elements, and therefore, some details are not described below for cushion system 700.

Figure 28:
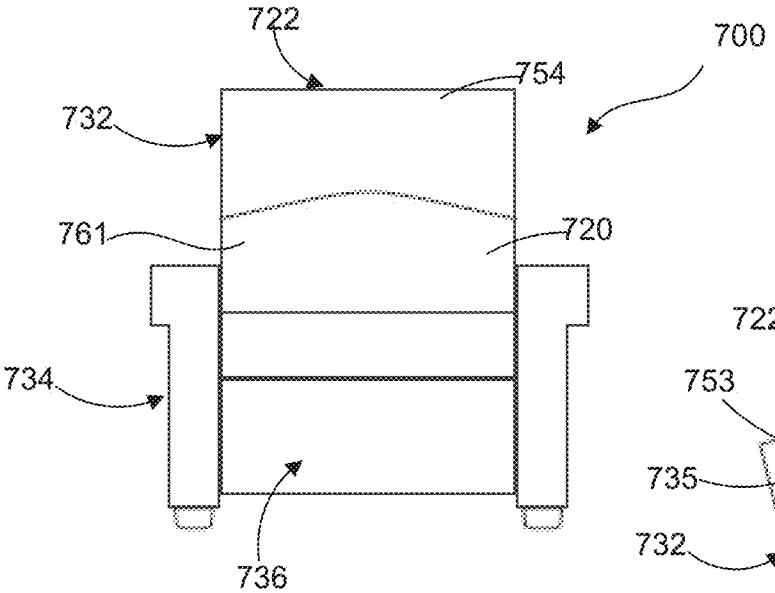
FIG. 28 is a front view of a therapeutic cushion system, according to another embodiment shown in a first configuration.

The support element 720 includes a curved top surface portion 733 (see, e.g., FIGS. 31 and 32) and also includes a cushion member (not shown) disposed within an outer casing 761 (see, e.g., FIG. 28). The cushion member of the support element 720 can include more than one cushion component and can be formed with, for example, one or more foam materials as described above for previous embodiments.

In this embodiment, the riser element 722 includes a fixed or stationary riser member 753 and a movable riser member 754. The fixed riser member 753 can include a cushion member(s) (not shown) that can be formed integrally or separately with the cushion member(s) of the support element 720. The cushion member(s) of the fixed riser member 753 can be formed with the same or different materials as the cushion member of the support element 720. The outer casing 761 can also encase the cushion member of the fixed riser member 753 in a similar manner as described above for riser element 622. The movable riser member 754 can include a pillow insert (not shown) as described above for previous embodiments (e.g., pillow insert 125) such that the movable riser member 754 can include a compliant region to allow a user to form cavities or bulges to accommodate specific body parts and/or portions to accommodate the user's needs and/or preferences. The movable riser member 754 also includes a curved bottom surface portion 743 (see, e.g., FIGS. 31 and 32).

Figure 29:
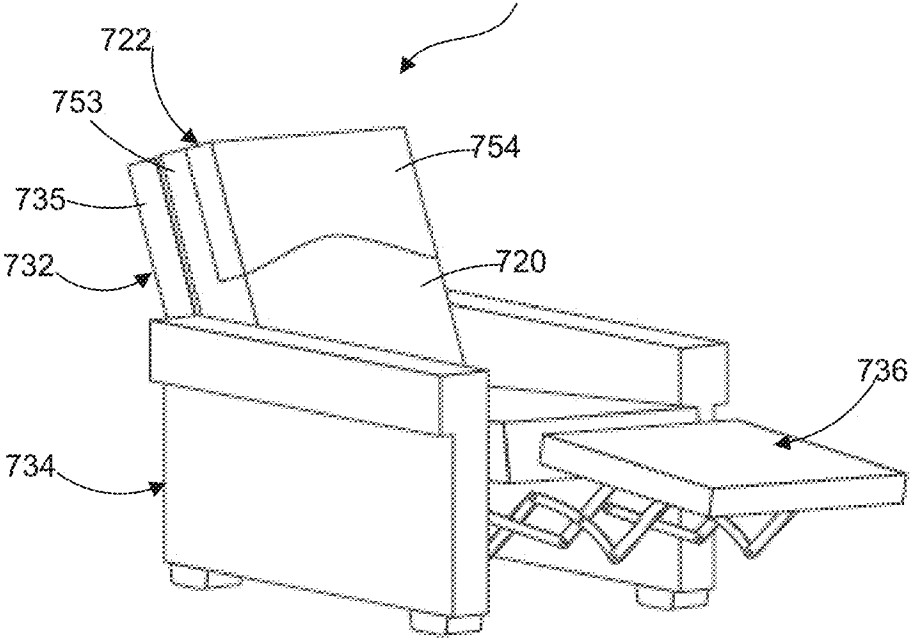
FIG. 29 is a side perspective view of the therapeutic cushion system of FIG. 28 shown in a second configuration.
Figures 30, 31:
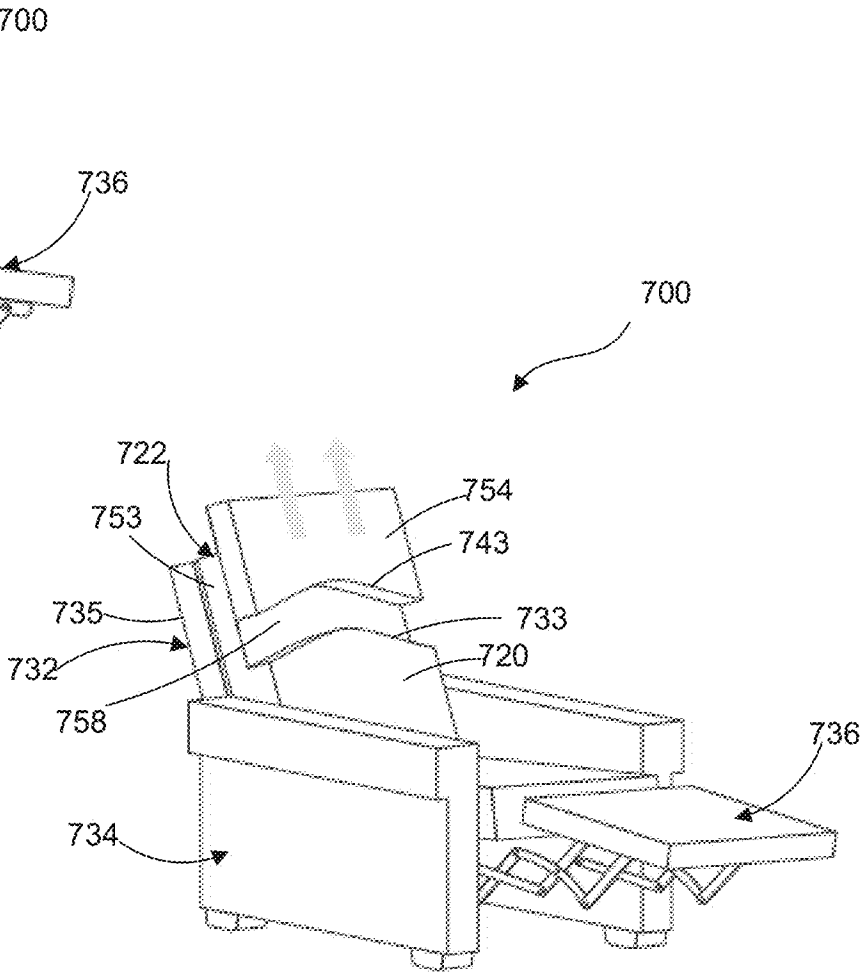
FIG. 30 is a side view of the therapeutic cushion system of FIG. 28 shown in a third configuration.
FIG. 31 is a side perspective view of the therapeutic cushion system of FIG. 28 shown in the second configuration with the riser element in an extended configuration.

The movable riser member 754 is movable between a first position in which the curved bottom surface portion 743 of the movable riser member 754 abuts or is positioned adjacent or in contact with the curved top surface portion 733 of the support member 720 (as shown in FIGS. 28-30), and a second extended position in which the movable riser member 754 is disposed at a non-zero distance from the support element 720 (as shown in FIGS. 31-34). For example, the movable riser member 754 can be coupled to a mechanism (not shown) coupled to the fixed riser member 753 and/or the back support member 735 that allows the movable riser member 754 to be slidably moved from its first position to its second extended position. When the movable riser member 754 is in its second position, the support element 720 and the movable riser member 722 collectively define a receiving portion 758 that can be used as a shoulder relief area for the user to place a portion of a user's arm and/or shoulder when using the cushion system 700.

Figure 33:
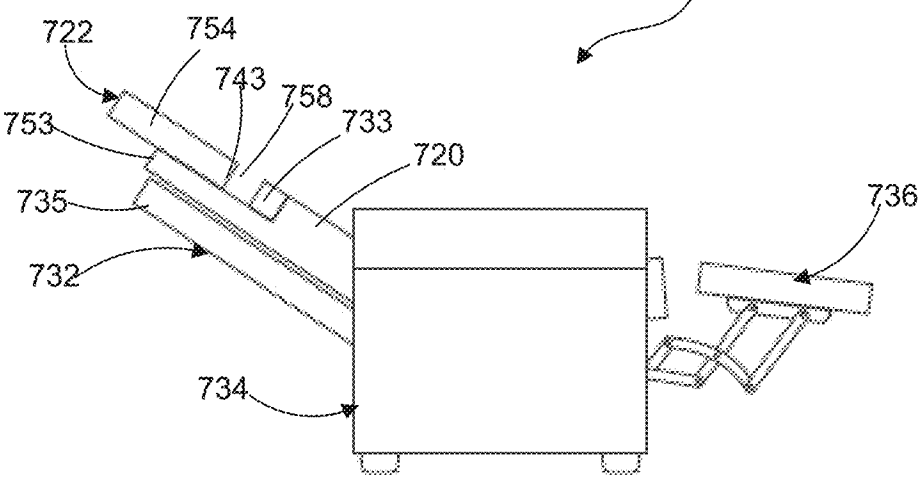
FIG. 33 is a side view of the therapeutic cushion system of FIG. 28 shown in the third configuration with the riser element in the extended configuration.
Figure 32:
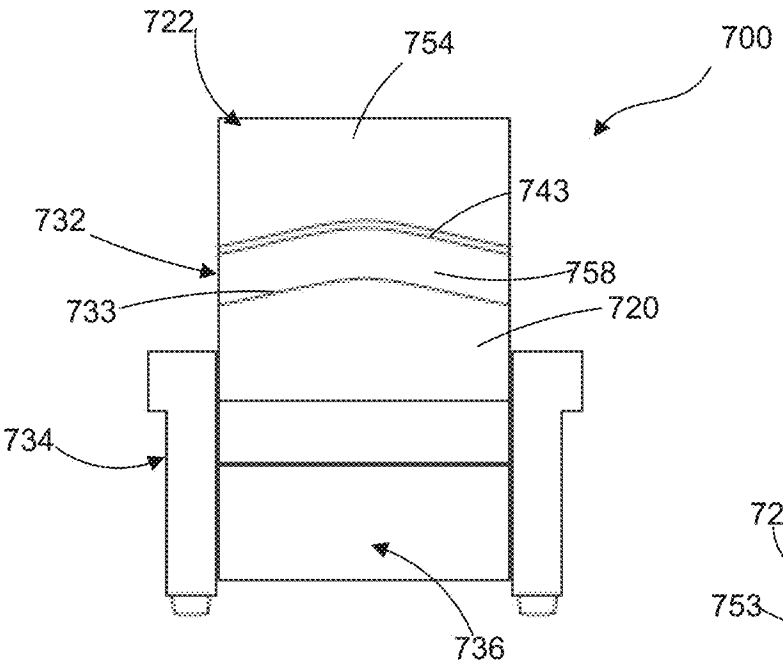
FIG. 32 is a front view of the therapeutic cushion system of FIG. 28 shown in the first configuration with the riser element in the extended configuration.
Figure 34:
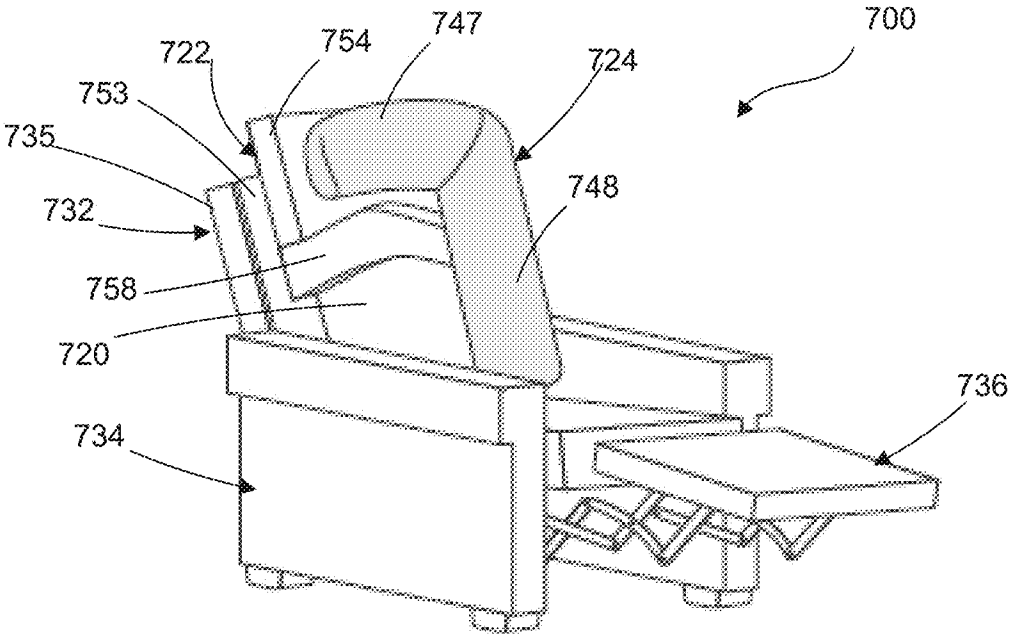
FIG. 34 is a side perspective view of the therapeutic cushion system of FIG. 28 shown in the second configuration with the riser element in the extended configuration and with an optional body element.

As described above for cushion system 600, the cushion system 700 can be moved between a substantially upright configuration, as shown, for example, in FIG. 28, and can be moved to various partially reclined configurations in which the back portion 732 is disposed at various angles relative to the seat portion 734, as shown, for example, in FIGS. 29, 31 and 34, and a fully reclined position, as shown in FIGS. 30 and 33. When the cushion system 700 is in its partially reclined or fully reclined configurations, the foot support portion 736 can be used to support the feet and legs of the user. The cushion system 700 can include features included in a typical recliner that can be used to move the cushion system 700 between the various configurations. For example, the cushion system 700 can include a mechanism that can be actuated by a user with, for example, a handle (not shown).

The cushion system 700 can also optionally include a body element 724, as shown in FIG. 34 that can be constructed with the same or similar materials as described above for previous embodiments of a body element. The body element 724 includes a first arm 747 and a second arm 748 disposed substantially perpendicular to each other. In alternative embodiments, the first arm 747 and the second arm 748 can be disposed at a different angle relative to each other such as greater than or less than 90 degrees. The body element 724 can be disposed on the cushion system 700 as described above for body element 624 and can help maintain the user in a side position when using the cushion system 700. The user can optionally use a separate pillow (not shown) to provide further head and neck support if desired.

The cushion system 700 can be used in a similar manner as described above for cushion system 600. For example, the therapeutic cushion system 700 can allow a user to sleep comfortably for an extended period of time in a substantially seated or a reclined position. The user can be positioned in a RLD position or LLD position as described above. Also as described above, when used in the reclined RLD position, the cushion system 700 can serve to minimize, or eliminate, gastro-esophageal reflux while it facilitates the emptying of the stomach into the duodenum of the user, and when the user is in the reclined LLD position, the cushion system 700 can serve to reduce reflux episodes of the user.

FIGS. 35-40 illustrate another embodiment of a therapeutic cushion system implemented within a reclining chair (also referred to as "recliner"). A therapeutic cushion system 800 (also referred to herein as "cushion system") includes a back portion 832, a seat portion 834 and a foot support portion 836. The back portion 832 includes a back support member 835 to which a support element 820 and a riser element 822 can be mounted or coupled. The support element 820 and the riser element 822 can each be constructed the same as or similar to, and can function the same as or similar to, the support elements and riser elements described above for previous elements, and therefore, some details are not described below for cushion system 800.

Figure 38:
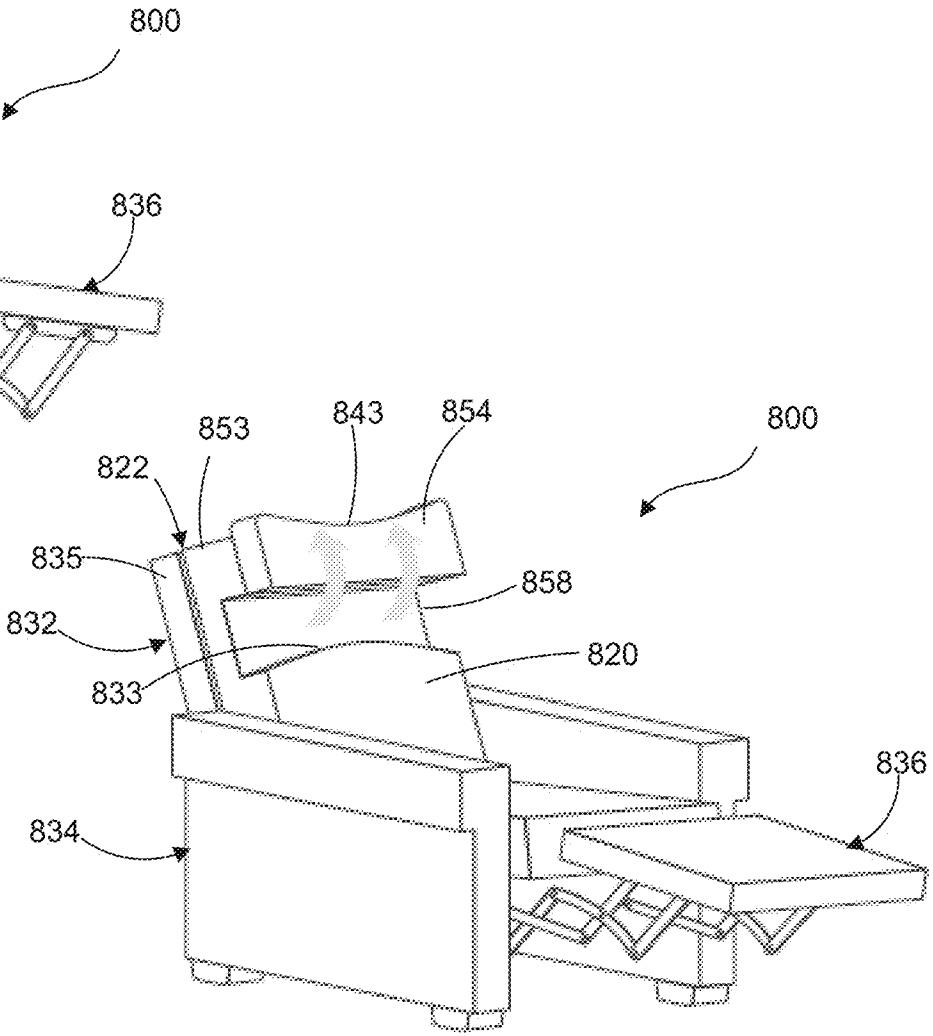
FIG. 38 is a side perspective view of the therapeutic cushion system of FIG. 35 shown in the second configuration and the riser element shown in an extended configuration.
Figure 39:
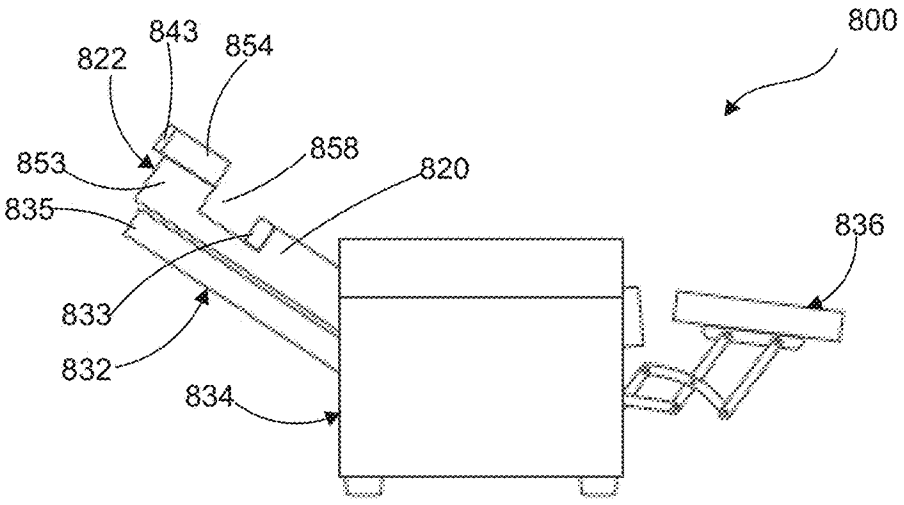
FIG. 39 is a side view of the therapeutic cushion system of FIG. 35 shown in the third configuration with the riser element in the extended configuration.
Figure 40:
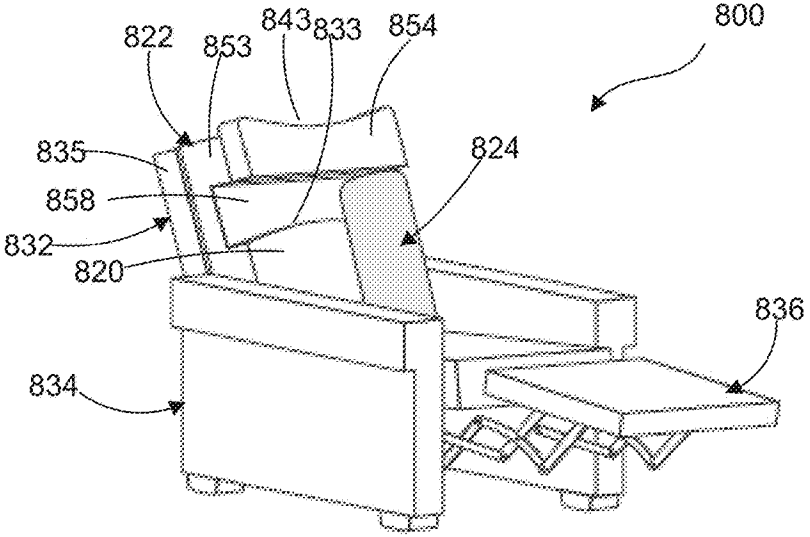
FIG. 40 is a side perspective view of the therapeutic cushion system of FIG. 35 shown in the second configuration with the riser element in the extended configuration and with a body element.

In this embodiment, the support element 820 includes a curved upper surface portion 833 (see, e.g., FIGS. 38-40). The support element 820 also includes a cushion member (not shown) disposed within an outer casing 861 (see, e.g., FIG. 35). The cushion member of the support element 720 can include more than one cushion component and be formed with, for example, one or more foam materials as described above for previous embodiments.

In this embodiment, the riser element 822 includes a fixed or stationary riser member 853 and a movable riser member 854. The fixed riser member 853 can include a cushion member (not shown) that can be formed integrally or separately with the cushion member of the support element 820. The cushion member of the fixed riser member 853 can be formed with the same or different materials as the cushion member of the support element 820. The outer casing 861 can also encase the cushion member of the fixed riser member 853 in a similar manner as described above for previous embodiments. The movable riser member 854 can include a pillow insert (not shown) as described above for previous embodiments (e.g., pillow insert 125) such that the movable riser member 854 can include a compliant region to allow a user to form cavities or bulges to accommodate specific body parts and/or portions to accommodate the user's needs and/or preferences. The movable riser member 854 also includes a curved bottom surface portion 843 (see, e.g., FIGS. 38-40).

Figure 36:
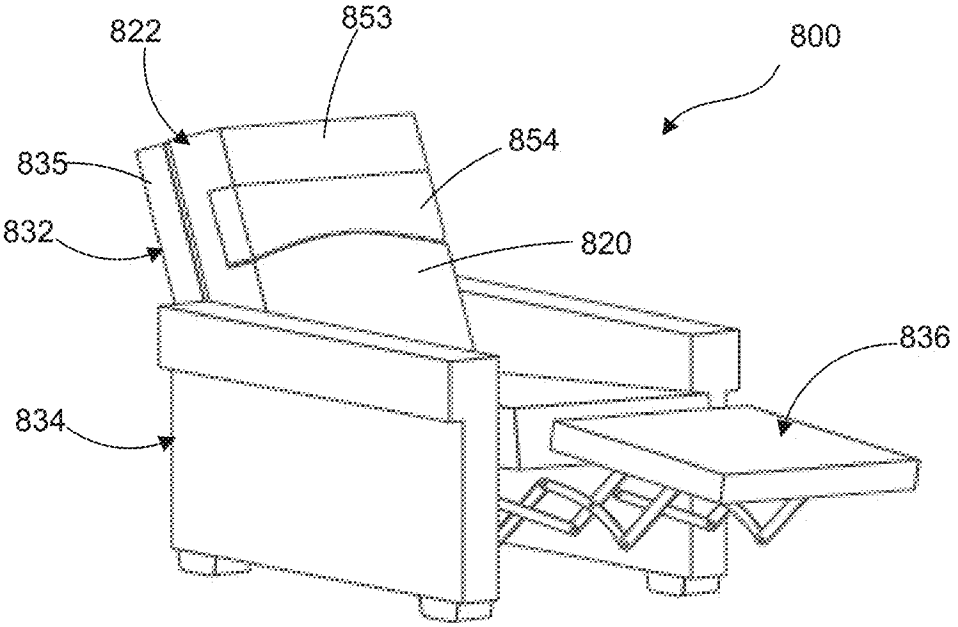
FIG. 36 is a side perspective view of the therapeutic cushion system of FIG. 35 shown in a second configuration.
Figure 35:
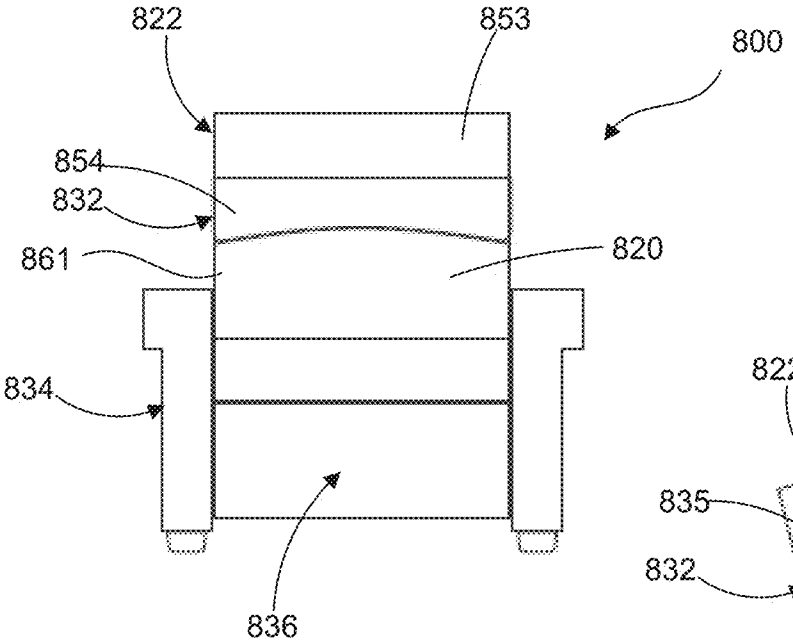
FIG. 35 is a front view of a therapeutic cushion system, according to another embodiment shown in a first configuration.
Figure 37:
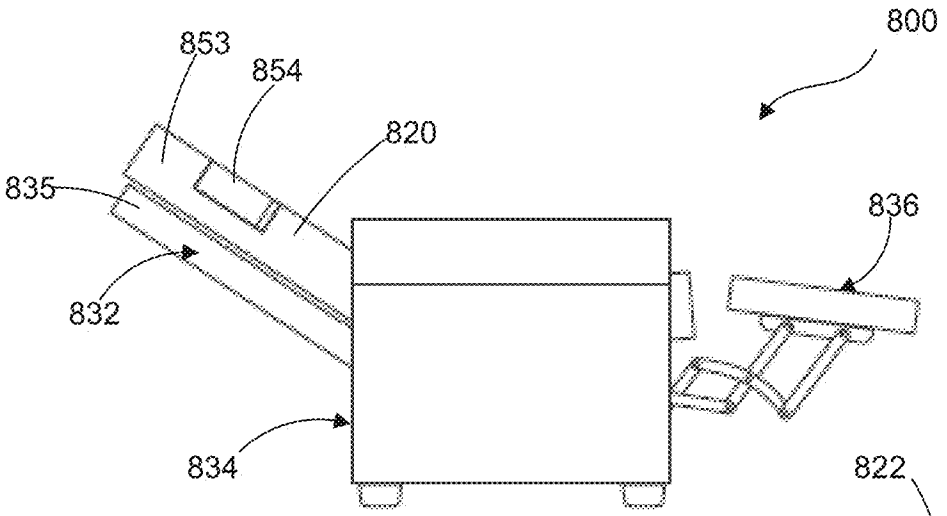
FIG. 37 is a side view of the therapeutic cushion system of FIG. 35 shown in a third configuration.

The movable riser member 854 is movable between a first position in which the curved bottom surface portion 843 of the movable riser member 854 abuts or is positioned adjacent or in contact with the curved top surface portion 833 of the support member 820 (as shown in FIGS. 35-37), and a second extended position in which the movable riser member 854 is disposed at a non-zero distance from the support element 820 (as shown in FIGS. 38-40). For example, in this embodiment, the movable riser member 854 can be pivotally coupled to the fixed riser member 853 such that the movable riser member 854 can be pivotally moved upward to a position in which the movable riser member 854 is disposed on top of the fixed riser member 853. When the movable riser member 854 is in its second extended position, the support element 820, the fixed riser member 853 and the movable riser member 854 collectively define a receiving portion 858 that can be used as a shoulder relief area for the user to place a portion of a user's arm and/or shoulder when using the cushion system 800.

As described above for cushion systems 600 and 700, the cushion system 800 can also be moved between a substantially upright configuration, as shown, for example, in FIG. 35, and can be moved to various partially reclined configurations in which the back portion 832 is disposed at various angles relative to the seat portion 834, as shown, for example, in FIGS. 36, 38 and 40, and a fully reclined position, as shown in FIGS. 37 and 39. When the cushion system 800 is its partially reclined or fully reclined configurations, the foot support portion 836 can be used to support the feet and legs of the user. The cushion system 800 can include features included in a typical recliner that can be used to move the cushion system 800 between the various configurations. For example, the cushion system 800 can include a mechanism that can be actuated by a user with, for example, a handle (not shown).

The cushion system 800 can also optionally include a body element 824, as shown in FIG. 40 that can be constructed with the same or similar materials as described above for previous embodiments of a body element. In this embodiment, the body element 824 is substantially straight and elongate such that when the body element 824 is disposed on the cushion system 800, as shown in FIG. 40, a top edge or surface of the body element 824 is disposed between the riser element 822 and the seat portion 834 of the cushion system 800. As with previous embodiments, the user can optionally use a separate pillow (not shown) to provide further head and neck support if desired.

The cushion system 800 can be used in a similar manner as described above for cushion systems 600 and 700. For example, the therapeutic cushion system 800 can allow a user to sleep comfortably for an extended period of time in a substantially seated or a reclined position. The user can be positioned in a RLD position or LLD position as described above. Also as described above, when used in the reclined RLD position, the cushion system 800 can serve to minimize, or eliminate, gastro-esophageal reflux while it facilitates the emptying of the stomach into the duodenum of the user, and when the user is in the reclined LLD position, the cushion system 700 can serve to reduce reflux episodes of the user.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above Where schematics and/or embodiments described above indicate certain components arranged in certain orientations or positions, the arrangement of components may be modified. While the embodiments have been particularly shown and described, it will be understood that various changes in form and details may be made. Any portion of the apparatus and/or methods described herein may be combined in any combination, except mutually exclusive combinations. The embodiments described herein can include various combinations and/or sub-combinations of the functions, components and/or features of the different embodiments described.

For example, any of the embodiments of a cushion system can include a support element with a top surface that is angled at an angle between, for example, 6-30 degrees relative to a bottom surface of the support element. Any of the body elements described herein can include an arc portion and the arc portion can be curved, for example, between about 30 and about 180 degrees. In another example, any embodiment of cushion system can include one or more side bolsters and or one or more side support members. The body elements can include a first arm and a second arm having a variety of different lengths not necessarily shown.

What is claimed is:

1. An apparatus, comprising:

a support element; and a riser element adjacent to the support element, the riser element and the support element collectively forming a body support member configured to support a user and collectively defining a receiving portion configured to receive a portion of the user's arm, the support element including a center portion disposed at a longitudinal centerline of the apparatus, the support element having a top surface disposed at an angle relative to a bottom surface; and the support element having a first end portion and a second end portion, the riser element being disposed proximate the second end portion, the second end portion having an end surface facing the riser element, the end surface extending from the center portion of the support element toward a lateral side of the apparatus such that a first portion of the end surface of the support element is disposed at a first distance from the riser element and a second portion of the end surface of the support element is disposed at a second distance from the riser element, the second distance being greater than the first distance.

2. The apparatus of claim 1, wherein the first portion of the end surface of the support element is associated with the center portion of the support element.

3. The apparatus of claim 1, wherein the receiving portion has a length defined in a direction of a width of the apparatus and a width defined in a direction perpendicular to the direction of the width of the apparatus, the width of the receiving portion varying in a direction of the length of the receiving portion.

4. The apparatus of claim 1, wherein the riser element is monolithically formed with the support element.

5. The apparatus of claim 1, further comprising:

a body element configured to be disposed on at least one of the support element or the riser element.

6. The apparatus of claim 5, wherein the body element has a first arm and a second arm connected by an arc portion.

7. The apparatus of claim 1, wherein the receiving portion is a first receiving portion, the riser element and the support element collectively define a second receiving portion configured to receive a portion of a user's arm.

8. The apparatus of claim 1, wherein the second end portion of the support element has a height greater than the first end portion of the support element.

9. An apparatus, comprising:

a support element; and a riser element integrally formed with the support element, the riser element and the support element collectively forming a body support member configured to support a user, the support element including a center portion at a longitudinal centerline of the apparatus, the support element having a top surface disposed at an angle relative to a bottom surface, the support element having a first end portion and a second end portion, the riser element being disposed proximate the second end portion, the second end portion having an end surface facing the riser element, a first portion of the end surface of the support element being disposed at a first distance from the riser element and a second portion of the end surface of the support element being disposed at a second distance from the riser element, the second distance being greater than the first distance, the support element and the riser element collectively defining a first receiving portion and a second receiving portion on an opposite side of the center portion of the support element, the first receiving portion and the second receiving portion each configured to receive at least a portion of a user's arm therein.

10. The apparatus of claim 9, wherein the first portion of the end surface of the support element is associated with the center portion of the support element.

11. The apparatus of claim 9, wherein the first receiving portion and the second receiving portion collectively have a length defined in a direction of a width of the apparatus and a width defined in a direction perpendicular to the direction of the width of the apparatus, the width of the first receiving portion and the second receiving portion varying in a direction of the length of the first receiving portion and he second receiving portion.

12. The apparatus of claim 9, further comprising:

a casing formed at least in part with a stretch material, the riser element and the support element each disposed within the casing.

13. The apparatus of claim 9, further comprising:

a body element configured to be disposed on at least one of the support element or the riser element and used to help maintain a user in a side position on the body support member.

14. The apparatus of claim 13, wherein the body element has a first arm and a second arm connected by an arc portion.

15. The apparatus of claim 9, wherein the second end portion of the support element has a height greater than the first end portion of the support element.

16. An apparatus, comprising:

a riser element; and a support element coupled to the riser element and collectively forming a body support member configured to support a user, the support element including a top surface disposed at an angle relative to a bottom surface, the support element having a first end portion and a second end portion, the riser element being disposed proximate the second end portion, the second end portion having an end surface facing the riser element, the support element and the riser element collectively defining a receiving portion between the end surface of the support element and the riser element, a first portion of the end surface of the support element being disposed at a first distance from the riser element and a second portion of the end surface of the support element being disposed at a second distance from the riser element, the second distance being greater than the first distance, the receiving portion configured to receive at least a portion of a user's arm therein.

17. The apparatus of claim 16, wherein the first portion of the end surface of the support element is associated with a center portion of the support element.

18. The apparatus of claim 16, wherein, the receiving portion has a length defined in a direction of a width of the apparatus and a width defined in a direction perpendicular to the direction of the width of the apparatus, the width of the receiving portion varying in a direction of the length of the receiving portion in a top view of the apparatus.

19. The apparatus of claim 16, wherein the receiving portion is a first receiving portion, the support element and the riser element collectively define a second receiving portion between the end surface of the support element and the riser element, the second receiving portion configured to receive at least a portion of a user's arm therein.

20. The apparatus of claim 16, further comprising:

a body element configured to be disposed on at least one of the support element or the riser element and used to help maintain a user in a side position on the body support member.

21. The apparatus of claim 20, wherein the body element has a first arm and a second arm connected by an arc portion.

22. The apparatus of claim 16, wherein the riser element has an end surface facing the end surface of the second end portion of the support element, the first portion of the end surface of the support element being disposed at a first distance from the end surface of the riser element and the second portion of the end surface of the support element being disposed at a second distance from the end surface of the riser element.

* * * * *